US007783217B2

(12) United States Patent
Maeda

(10) Patent No.: US 7,783,217 B2
(45) Date of Patent: Aug. 24, 2010

(54) FIXING APPARATUS, IMAGE FORMING APPARATUS, METHOD FOR CONTROLLING TEMPERATURE OF FIXING APPARATUS, AND COMPUTER-READABLE STORAGE MEDIUM STORING PROGRAM FOR CONTROLLING TEMPERATURE OF FIXING APPARATUS IN ACCORDANCE WITH TRANSPORT SPEED OF RECORDING MEDIUM

(75) Inventor: Tomohiro Maeda, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 885 days.

(21) Appl. No.: 11/625,411

(22) Filed: Jan. 22, 2007

(65) Prior Publication Data

US 2007/0196120 A1 Aug. 23, 2007

(30) Foreign Application Priority Data

Feb. 20, 2006 (JP) ..... 2006-043056

(51) Int. Cl.
*G03G 15/20* (2006.01)

(52) U.S. Cl. ..... 399/69; 399/328

(58) Field of Classification Search ..... 399/69, 399/328, 330

See application file for complete search history.

(56) References Cited

U.S. PATENT DOCUMENTS 5,361,088 A * 11/1994 Ito et al.
6,148,163 A * 11/2000 Ito ..... 399/69
2005/0117942 A1 6/2005 Ishii et al.

FOREIGN PATENT DOCUMENTS

| | | |
|---|---|---|
| JP | 52-17031 | 2/1977 |
| JP | 10-149044 | 6/1998 |
| JP | 11-038802 | 2/1999 |
| JP | 2002-182503 | 6/2002 |
| JP | 2002-229376 | 8/2002 |
| JP | 2003-233274 | 8/2003 |
| JP | 2005-043619 | 2/2005 |
| JP | 2005-70602 A | 3/2005 |
| JP | 2005-189427 | 7/2005 |
| JP | 2005-292714 | 10/2005 |

OTHER PUBLICATIONS

Machine translation of Fujino (JP 2005-292714) [listed on IDS dated Jan. 22, 2007]—provided for applicants' assistance.*

* cited by examiner

*Primary Examiner*—David M Gray
*Assistant Examiner*—Laura K Roth
(74) *Attorney, Agent, or Firm*—Renner, Otto, Boisselle & Sklar, LLP

(57) ABSTRACT

In a fixing apparatus which is included in an image forming apparatus that is capable of selecting a sheet transport speed, a paper sheet is transported between a fixing roller and a pressure roller, so that an unfixed image formed on the paper sheet is fixed on the paper sheet under heat of the fixing roller. The fixing apparatus is provided with an endless belt which heats the outer surface of the fixing roller by external contact with the outer surface of the fixing roller, and a halogen lamp, a heat source control device, and a thermistor all of which are for changing a temperature of the endless belt in accordance with the sheet transport speed. This makes it possible to fix an image on a paper sheet without the occurrence of offset phenomena.

10 Claims, 10 Drawing Sheets

FIG. 10 (a)

IDENTICAL TRANSPORT SPEED IN COLOR MODE AND MONOCHROME MODE

| OUTER SURFACE TEMPERATURE OF FIXING ROLLER | COLOR | MONOCHROME |
|---|---|---|
| 210°C | H | H |
| 200°C | H | O |
| 190°C | H | O |
| 180°C | O | O |
| 170°C | O | O |
| 160°C | C | O |
| 150°C | C | C |

H・・・HOT OFFSET
C・・・COLD OFFSET
O・・・APPROPRIATE TEMPERATURE RANGE

OVERLAP RANGE

FIG. 10 (b)

TRANSPORT SPEED OF 170 mm/s IN COLOR MODE AND 350 mm/s IN MONOCHROME MODE

| OUTER SURFACE TEMPERATURE OF FIXING ROLLER | COLOR | MONOCHROME |
|---|---|---|
| 210°C | H | O |
| 200°C | H | O |
| 190°C | H | O |
| 180°C | O | C |
| 170°C | O | C |
| 160°C | C | C |
| 150°C | C | C |

H・・・HOT OFFSET
C・・・COLD OFFSET
O・・・APPROPRIATE TEMPERATURE RANGE

FIXING APPARATUS, IMAGE FORMING APPARATUS, METHOD FOR CONTROLLING TEMPERATURE OF FIXING APPARATUS, AND COMPUTER-READABLE STORAGE MEDIUM STORING PROGRAM FOR CONTROLLING TEMPERATURE OF FIXING APPARATUS IN ACCORDANCE WITH TRANSPORT SPEED OF RECORDING MEDIUM

This Nonprovisional application claims priority under 35 U.S.C. §119(a) on Patent Application No. 43056/2006 filed in Japan on Feb. 20, 2006, the entire contents of which are hereby incorporated by reference.

FIELD OF THE INVENTION

The present invention relates to a fixing apparatus which is included in an electrophotographic image forming apparatus, a method for controlling a temperature of the fixing apparatus, a program for controlling a temperature of the fixing apparatus, and a computer-readable storage medium.

BACKGROUND OF THE INVENTION

An electrophotographic image forming apparatus (e.g. printer) includes a fixing apparatus that fuses a toner image formed on a sheet of paper so as to fix the toner image on the sheet of paper. Known as an example of the fixing apparatus is a fixing apparatus which includes a pair of rollers, a fixing roller and a pressure roller, as shown in Patent documents 2 through 4.

The fixing roller is a roller member that has (a) a hollow shaft which is made of metal such as aluminum, (b) an elastic layer which is formed on the surface of the hollow shaft, and (c) a halogen lamp which is disposed as a heat source inside the shaft. A temperature control device controls a temperature of the fixing roller by performing on-off control of the halogen lamp in accordance with a signal outputted from a temperature sensor which is provided on the surface of the fixing roller.

Apart from the aforementioned halogen lamp, an external heating member which press-contacts the outer surface of the fixing roller is known as means for heating the fixing roller. Specific examples of the external heating member include an external heating roller which is disclosed in Patent document 1 mentioned below and an external heating belt which is disclosed in Patent documents 2 through 4. Since the external heating member directly contacts the outer surface of the fixing roller, the external heating member can heat the outer surface of the fixing roller more quickly than the aforementioned halogen lamp.

The pressure roller is a roller member which has a shaft and a heat-resistant elastic layer provided as a covering layer around the shaft. The heat-resistant elastic layer is made of a silicone rubber, for example. The pressure roller press-contacts the outer surface of the fixing roller, which causes elastic deformation of the elastic layer of the pressure roller. This forms a nip region between the fixing roller and the pressure roller.

In the above arrangement, fixing of an unfixed toner image on a sheet of paper is performed as follows. A sheet of paper having unfixed toner image formed thereon is caught in the nip region between the fixing roller and the pressure roller and transported by rotation of the fixing roller and the pressure roller. Then, the toner image formed on the sheet of paper is fused by heat given off from the outer surface of the fixing roller so that the toner image can be fixed on the sheet of paper.

In such a fixing apparatus, it is known that offset phenomenon such as cold offset and hot offset occurs when a temperature on the outer surface of the fixing roller falls outside an appropriate temperature range. The cold offset is a phenomenon in which due to lack of the amount of heat transferred to a sheet of paper, a part of insufficiently melted toner sticks to the fixing roller. The hot offset is a phenomenon in which due to overheating of a toner on a sheet of paper, a cohesive force of the toner decreases, and a part of the toner on the sheet of paper sticks to the fixing roller.

Thus, it is very important for the fixing apparatus to control a temperature of the fixing roller so that a temperature on the surface of the fixing roller is within the appropriate temperature range during sheet passing.

(Patent document 1)

Japanese Unexamined Patent Publication No. 038802/1999 (Tokukaihei 11-038802; published on Feb. 12, 1999)

(Patent document 2)

Japanese Unexamined Patent Publication No. 189427/2005 (Tokukai 2005-189427; published on Jul. 14, 2005)

(Patent document 3)

Japanese Unexamined Patent Publication No. 292714/2005 (Tokukai 2005-292714; published on Oct. 20, 2005)

(Patent document 4)

Japanese Unexamined Patent Publication No. 017031/1977 (Tokukaisho 52-017031; published on Feb. 8, 1977)

The appropriate temperature range of the outer surface of the fixing roller varies depending upon a sheet transport speed of an image forming apparatus where the fixing apparatus is installed. More specifically, the appropriate temperature range tends to shift to higher temperatures with increase of the sheet transport speed (process speed) and shifts to lower temperatures with decrease of the sheet transport speed. The reasons for the tendency are as follows. In cases where the sheet transport speed is high, a time for the contact between the sheet of paper and the outer surface of the fixing roller is short. Hence, sufficient heat is not transferred from the outer surface of the fixing roller to a sheet of paper unless a temperature on the outer surface of the fixing roller is relatively high. On the other hand, in cases where the sheet transport speed is low, the contact time is long. Hence, excessive heat is transferred from the outer surface of the fixing roller to a sheet of paper unless the temperature on the outer surface of the fixing roller is suppressed.

The so-called 4-cycle electrophotographic image forming apparatus is usually designed to have a substantially identical sheet transport speed in (a) cases where a color image is formed on a sheet of paper and (b) cases where a monochrome image is formed thereon (It is to be noted that an interval between the sheets of paper transported is different in the color image formation and monochrome image formation, and the number of sheets processed per unit time are therefore larger in the monochrome image formation.).

In a fixing apparatus included in the 4-cycle electrophotographic image forming apparatus, when the appropriate temperature range to fix color images is compared with the appropriate temperature range to fix monochrome images, a wide range of overlap therebetween exists, as illustrated in FIG. 10(*a*). Therefore, by setting a control value of a temperature of the surface of the fixing roller so as to fall within the overlap range, it becomes easy to perform temperature control such that a temperature of the outer surface of the fixing roller falls within an appropriate temperature range both in the case of color image fixing and the case of monochrome image fixing. This avoids the occurrence of the offset phenomena.

However, a demand for a four drum tandem engine image forming apparatus which is designed to have a higher sheet transport speed in forming a monochrome image on a sheet of paper than in forming a monochrome image thereon has recently been increasing (In other words, designed to have greatly different sheet transport speeds between in monochrome image forming mode and in color image forming mode.). This is because the image forming apparatus designed as above can increase the number of paper sheets processed for monochrome image without degrading image quality of a monochrome image formed.

In an image forming apparatus which is designed to have a higher sheet transport speed in forming a monochrome image on a sheet of paper than in forming a monochrome image thereon, when the appropriate temperature range to fix color images is compared with the appropriate temperature range to fix monochrome images, a very narrow range of overlap or no overlap therebetween exists, as illustrated in FIG. 10(*b*). In cases where a range of overlap therebetween is very narrow, it is difficult to perform temperature control for a surface temperature of the fixing roller falling within the overlap range even if a control value for a surface temperature of the fixing roller is set so as to fall within the overlap range. In this case, the cold offset problem and hot offset problem are likely to occur. In cases where no overlap range exists, it is difficult to suppress the offset phenomena no matter what control value is set.

SUMMARY OF THE INVENTION

An object of the present invention is to provide a fixing apparatus which is included in an image forming apparatus that is capable of selecting a sheet transport speed, and can fix an image on a sheet of paper without causing offset phenomena.

In order to achieve the above object, the present invention is such that a fixing apparatus includes: a fixing roller; and a pressure roller, wherein a recording material is transported between the fixing roller and the pressure roller, so that an unfixed image formed on the recording material is fixed on the recording material under heat of the fixing roller, and the fixing apparatus further includes: an external heating member which heats the outer surface of the fixing roller by external contact with the outer surface of the fixing roller; and a temperature control section which controls a temperature of the external heating member in accordance with a transport speed of the recording material.

According to the above arrangement, a temperature of the external heating member that is in contact with the outer surface of the fixing roller can be changed in accordance with a selected speed for transport of the recording material. This makes it possible to quickly change a temperature of the outer surface of the fixing roller to an optimum temperature for operation at the selected transport speed (temperature at which less offset phenomena occur). Thus, even such an arrangement that the transport speed of the image forming apparatus is selectable brings about the effect of suppressing the occurrence of offset phenomenon.

Further, the present invention may be such that an image forming apparatus includes a fixing roller and a pressure roller, and performs a process in which a recording material is transported between the fixing roller and the pressure roller, so that an unfixed image formed on the recording material is fixed on the recording material under heat of the fixing roller, and the image forming apparatus further includes: an external heating member which heats the outer surface of the fixing roller by external contact with the outer surface of the fixing roller; and a temperature control section which controls a temperature of the external heating member in accordance with a transport speed of the recording material. This arrangement can also bring about an effect that is substantially the same as the above mentioned effect.

Still further, the present invention may be such that a method for controlling a temperature of a fixing apparatus includes: a fixing roller; and a pressure roller; and an external heating member which heats the outer surface of the fixing roller by external contact with the outer surface of the fixing roller, wherein a recording material is transported between the fixing roller and the pressure roller, so that an unfixed image formed on the recording material is fixed on the recording material under heat of the fixing roller, and the method includes the step of: performing control so that a temperature of the external heating member is changed in accordance with a transport speed of the recording material. This arrangement can also bring about an effect that is substantially the same as the above mentioned effect.

Note that the temperature control method may be realized by a computer. In such a case, (i) a temperature control program which causes a computer to execute the above mentioned step and (ii) a computer-readable storage medium storing therein the temperature control program are also included in the scope of the present invention.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3(*b*) is a graph illustrating temperature progression of the fixing roller and the endless belt of the fixing apparatus illustrated in FIG. 1 in a color mode.

FIG. 4(*b*) is a graph illustrating the temperature progression of the fixing roller and the endless belt in the monochrome mode in cases where power supply to a halogen lamp provided inside the fixing roller is performed.

FIG. 6(*b*) is a graph illustrating the temperature progression of the fixing roller and the external heating roller of the fixing apparatus illustrated in FIG. 5 in the color mode.

FIG. 7(*b*) is a diagram schematically illustrating the structure of a fixing apparatus in which the first support roller and the second support roller include respective halogen lamps therein.

FIG. 8(*b*) is a graph illustrating temperature progression of the fixing roller and the endless belt when continuous sheet passing was performed using an external heating device illustrated in FIG. 7(*a*) in the monochrome mode.

FIG. 8(*c*) is a graph illustrating temperature progression of the fixing roller and the endless belt when continuous sheet passing was performed using an external heating device illustrated in FIG. 7(*b*) in the monochrome mode.

FIG. 10(*a*) is a view illustrating an appropriate range of an outer temperature of a fixing roller in an image forming apparatus in which a transport speed is identical in the color mode and the monochrome mode.

FIG. 10(*b*) is a view illustrating an appropriate range of an outer temperature of a fixing roller in an image forming apparatus in which a transport speed is not identical in the color mode and the monochrome mode.

DESCRIPTION OF THE EMBODIMENTS

Figure 2:
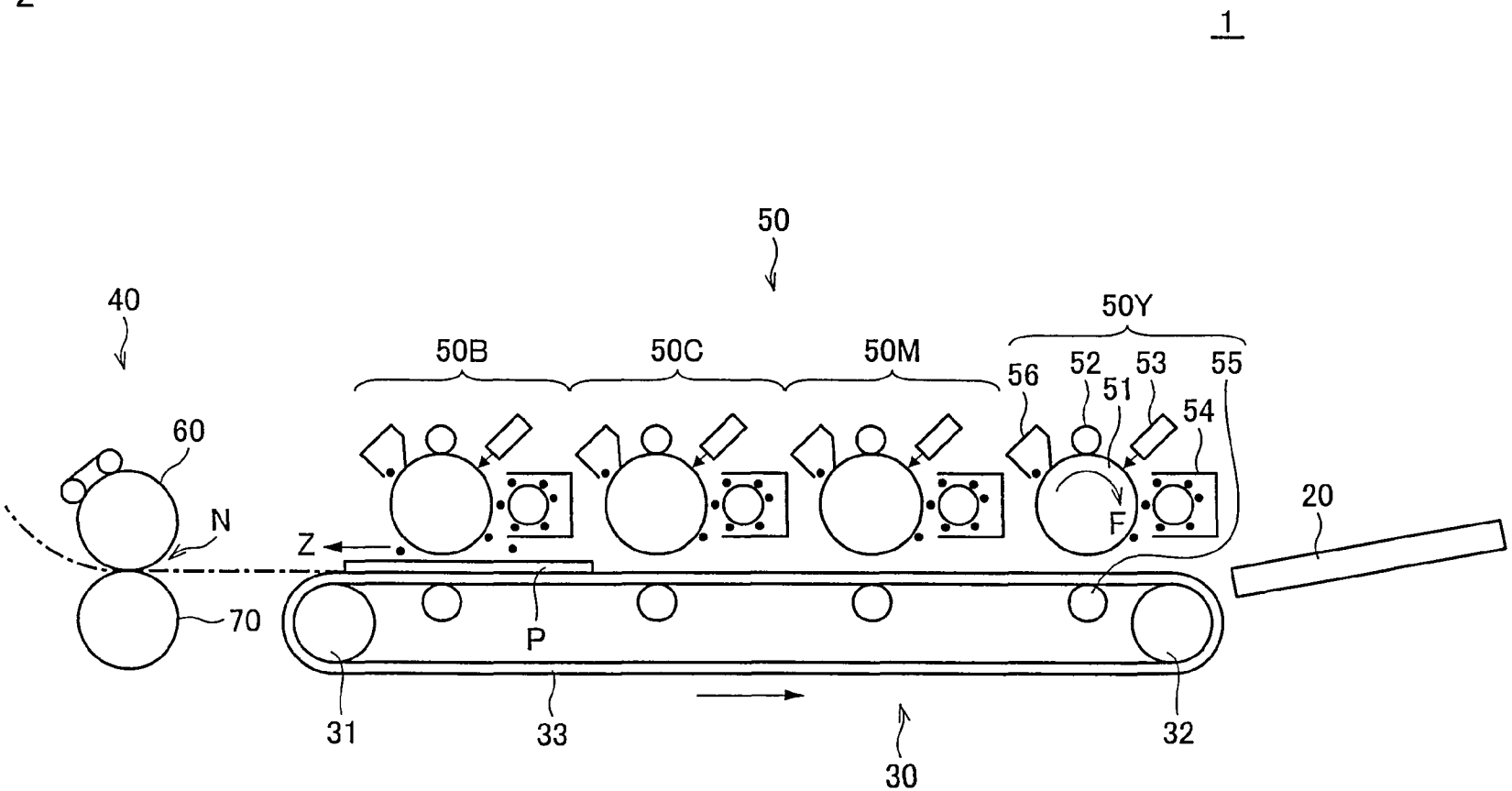
FIG. 2 is a diagram illustrating an internal structure of an image forming apparatus which includes the fixing apparatus illustrated in FIG. 1.

An embodiment of the present invention will be described below with reference to drawings. First of all, an image forming apparatus which includes a fixing apparatus of the present embodiment will be described with reference to FIG. 2. FIG. 2 is a diagram schematically illustrating an internal structure of the image forming apparatus.

An image forming apparatus 1 illustrated in FIG. 2 is a printer which selectively forms color images or monochrome images on paper sheets (recording material) P based on (i) image data that are transmitted from terminal devices each connected to the image forming apparatus 1 via a network or (ii) image data that are scanned by a scanner.

The image forming apparatus 1 is a dry electrophotographic and four drum tandem engine color printer, and includes a visible image transferring section 50, a sheet transporting section 30, a fixing apparatus 40, and a supply tray 20.

The visible image transferring section 50 consists of a yellow image transferring section 50Y, a magenta image transferring section 50M, a cyan image transferring section 50C, and a black image transferring section 50B. More specifically, the yellow image transferring section 50Y, the magenta image transferring section 50M, the cyan image transferring section 50C, and the black image transferring section 50B are disposed in this order in a direction from the supply tray 20 side toward the fixing apparatus 40 side.

The transferring sections 50Y, 50M, 50C, 50B have substantially the same structure and transfer a yellow image, a magenta image, a cyan image, and a black image on the paper sheet P, respectively.

Each of the transferring sections 50Y, 50M, 50C, 50B includes a photoreceptor drum 51. Around the photoreceptor drum 51 are there further disposed an electrostatic charger 52, an LSU 53, a development unit 54, a transfer roller 55, and a cleaning device 56, which are arranged along a rotational direction of the photoreceptor drum 51 (direction indicated by an arrow F in FIG. 2).

In each of the transferring sections 50Y, 50M, 50C, 50B, the photoreceptor drum 51 is a drum-shaped transfer roller which has a photosensitive material on a surface thereof, and rotates in a direction indicated by the arrow F. The electrostatic charger 52 is a charger-type corona discharger for evenly (uniformly) charging the surface of the photoreceptor drum 51.

To the respective LSUs (laser beam scanner units) 53 of the transferring sections 50Y, 50M, 50C, 50B, pixel signals corresponding to yellow component, magenta component, cyan component, and black component of the image data are supplied, respectively. The LSUs 53 perform exposures of the charged photoreceptor drums 51 in accordance with such image signals to form electrostatic latent images.

The respective development units 54 of the transferring sections 50Y, 50M, 50C, 50B have a yellow toner, a magenta toner, a cyan toner, and a black toner, respectively. The development units 54 have a function of developing, with these toners, the electrostatic latent images formed on the photoreceptor drums 51 to form toner images (developed images).

The respective transfer rollers 55 of the transferring sections 50Y, 50M, 50C, 50B are subjected to application of a bias voltage which is opposite in polarity to toner. By applying the bias voltage to the paper sheet P, each of the transfer rollers 55 transfers the toner image formed on the photoreceptor drum 51 onto the paper sheet P. The respective cleaning devices 56 of the transferring sections 50Y, 50M, 50C, and 50B remove residual toners from the photoreceptor drums 51 after image transfer onto the paper sheet P. Transfer of the toner image onto the paper sheet P is carried out once for each color.

The sheet transporting section 30 is composed of a drive roller 31, an idling roller 32, and a transport belt 33. The sheet transporting section 30 transports the paper sheet P so that toner images are formed on the paper sheet P by the transferring sections 50Y, 50M, 50C, 50B in this order.

The drive roller 31 and the idling roller 32 support the transport belt 33 in a tensioned state. The drive roller 31 rotates at a predetermined circumferential speed under control, so that the transport belt 33 rotates.

The transport belt 33 is set over the drive roller 31 and the idling roller 32 so as to come into contact with the photoreceptor drum 51 of the transferring sections 50Y, 50M, 50C, SOB. The transport belt 33 is caused by the rollers 31 and 32 to perform friction drive in a direction indicated by an arrow Z. The transport belt 33 attaches the paper sheet P transported from the supply tray 20 by means of electrostatic charges so that the paper sheet P is transported to the transferring sections 50Y, 50M, 50C, 50B in this order.

The paper sheet P that has the toner images transferred thereon by the transferring sections 50Y, 50M, 50C, 50B is separated from the transport belt 33 by a curvature of the drive roller 31 and then transported to the fixing apparatus 40 (A dashed line in FIG. 2 indicates a path over which the paper sheet P travels.). The toner images that have been transferred onto the paper sheet P by the transferring sections 50Y, 50M, 50C, 50B are unfixed with respect to the paper sheet P.

The fixing apparatus 40 fixes the unfixed toner images, which have been transferred onto the paper sheet P, to the paper sheet P by thermo compression bonding. More specifically, the fixing apparatus 40 includes a fixing roller 60 and a pressure roller 70. The paper sheet P that has been transported from the visible image transferring section 50 is fed to a fixing nip area N that is provided between the fixing roller 60 and the pressure roller 70. Further, the paper sheet P is transported between the fixing roller 60 and the pressure roller 70. During the transport, the toner images (unfixed images) formed on the paper sheet P is fixed to the paper sheet P under heat of the fixing roller 60.

After having been subjected to toner image fixing process by the fixing apparatus 40, the paper sheet P is ejected into an external output tray (not shown) that is provided to the image forming apparatus 1. This completes the image forming process. A structure of the fixing apparatus 40 will be specifically described later.

The above image forming apparatus 1 has a color mode (multicolor mode) in which the transferring sections 50Y, 50M, 50C, 50B transfer images to the paper sheet P to form color images (multicolor images) and a monochrome mode (single color mode) in which only the black image transferring sections 50B transfers images to the paper sheet P to form monochrome images (single color images). More specifically, a control section (control integrated circuit substrate or computer (not shown)) which is provided in the image forming apparatus 1 selects either a color mode or a monochrome mode in accordance with an incoming instruction entered by a user. Then, the control section controls the transferring sections 50Y, 50M, 50C, 50B so that the transferring sections 50Y, 50M, 50C, 50B perform image formation according to the selected mode.

Furthermore, the control section controls sheet transporting means (sheet transporting section 30, fixing roller 60, pressure roller 70, and others) of the image forming apparatus 1 so that the sheet transporting means transports the paper sheet P at a transport speed of 170 mm/s (also referred to as a process speed) in the color mode and at a transport speed of 350 mm/s in the monochrome mode. This realizes continuous paper feeding of 40 sheets per minute in the color mode and 70 sheets per minute in the monochrome mode.

Figure 1:
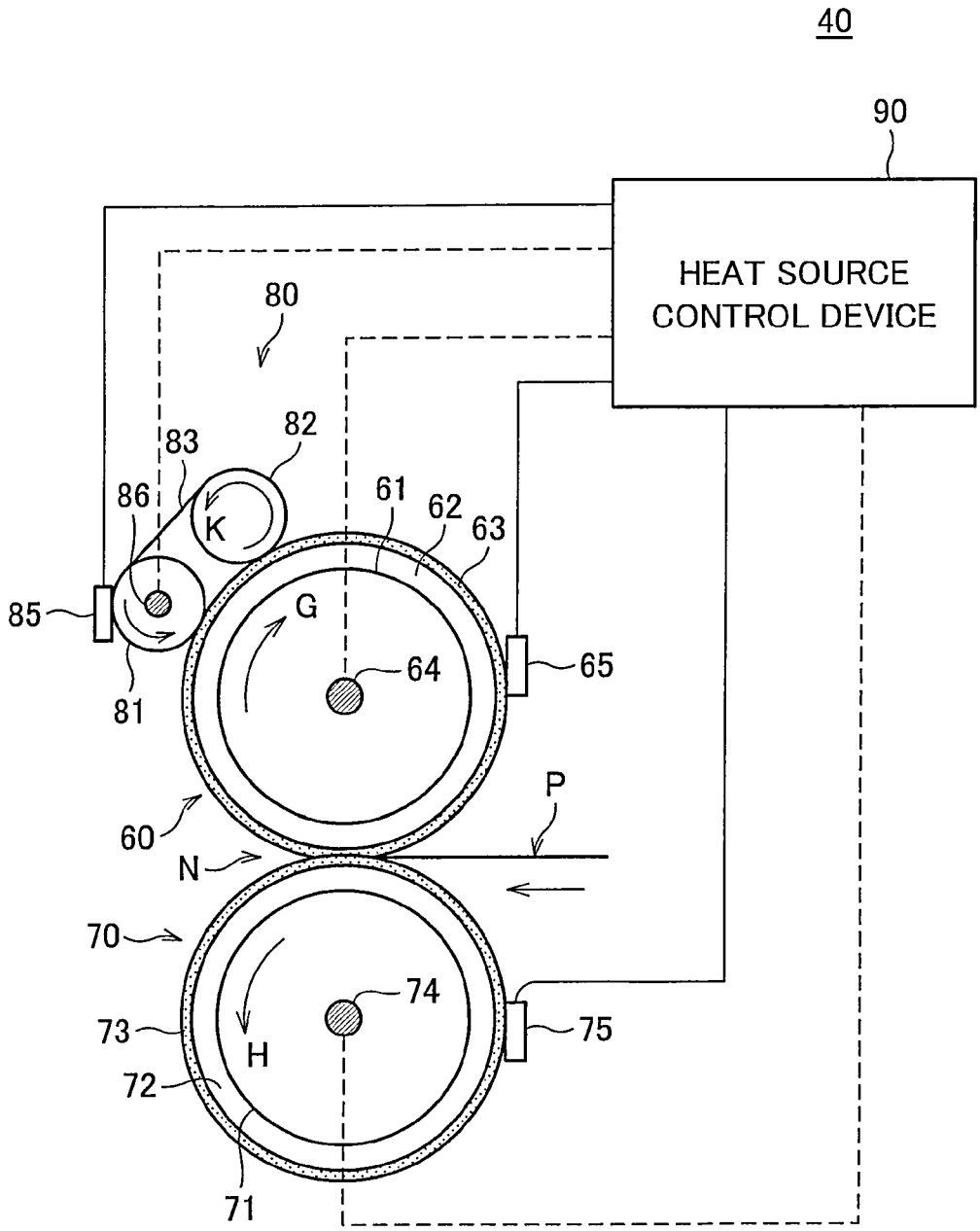
FIG. 1 is a diagram schematically illustrating a structure of a fixing apparatus according to an embodiment of the present invention.

Next, the above mentioned fixing apparatus 40 will be specifically described with reference to FIG. 1. FIG. 1 is a diagram schematically illustrating a structure of the fixing apparatus 40 of the present embodiment. The fixing apparatus 40 includes, in addition to the above mentioned fixing roller 60 and pressure roller 70, an external heating device 80 and a heat source control device 90.

The fixing roller 60 is a roller that rotates in a direction indicated by an arrow G illustrated in FIG. 1. The fixing roller 60 is made up of a hollow cylindrical shaft 61 that is made of a metal, an elastic layer 62 that coats the perimeter of the shaft 61, and a release layer 63 that is formed to coat the elastic layer 62.

The shaft 61 has an external diameter of 46 mm and is made of aluminum. However, a material for the shaft 61 is not limited to aluminum and may be iron or stainless steel, for example. The elastic layer 62 has a thickness of 2 mm and is made of silicone rubber having heat resistance. The release layer 63 is realized by a PFA (tetrafluoroethylene-perfluoroalkyl vinyl ether copolymer) tube having a thickness of approximately 30 μm. A material for the release layer 63 may be anything, provided that it is excellent in heat resistance, durability, and toner releasing property. The material for the release layer 63 may be fluorine material such as PTFE (polytetrafluoroethylene), apart from PFA. The fixing roller 60 made up as above has an external diameter of 50 mm and a surface hardness of 68 degrees (Asker-C hardness).

On the outer surface of the fixing roller 60, a thermistor (second temperature sensor) 65 is in contact with the fixing roller 60. The thermistor 65 detects a temperature of the outer surface of the fixing roller 60. Inside the shaft 61 installed is a halogen lamp (second heat source device) 64 which performs heat radiation in response to power supply to the halogen lamp 64. The halogen lamp 64 is a heat source of the fixing roller 60. When power is supplied to the halogen lamp 64, the halogen lamp 64 heats the inside of the fixing roller 60.

The pressure roller 70 is a roller that rotates in a direction indicated by an arrow H illustrated in FIG. 1. The pressure roller 70 is made up of a hollow cylindrical shaft 71 that is made of metal, an elastic layer 72 that coats the perimeter of the shaft 71, and a release layer 73 that is formed to coat the elastic layer 72.

The shaft 71 has an external diameter of 46 mm and is made of aluminum. However, a material for the shaft 71 is not limited to aluminum and may be iron or stainless steel, for example. The elastic layer 72 has a thickness of 2 mm and is made of silicone rubber having heat resistance. The release layer 73 is realized by a PFA tube having a thickness of approximately 30 μm. A material for the release layer 73 may be anything, provided that it is excellent in heat resistance, durability, and toner releasing property. The material for the release layer 73 may be fluorine material such as PTFE, apart from PFA. The pressure roller 70 made up as above has an external diameter of 50 mm and a surface hardness of 75 degrees (Asker-C hardness).

The pressure roller 70 is press-contacted to the fixing roller 60 by an elastic member (spring) not shown. This forms a fixing nip area N between the outer surface of the fixing roller 60 and the outer surface of the pressure roller 70.

On the outer surface of the pressure roller 70, a thermistor 75 is in contact with the pressure roller 70. The thermistor 75 detects a temperature of the outer surface of the pressure roller 70. Inside the shaft 71 installed is a halogen lamp 74 that performs heat radiation in response to power supply to the halogen lamp 74. The halogen lamp 74 is a heat source of the pressure roller 70. When power is supplied to the halogen lamp 74, the halogen lamp 74 heats the inside of the pressure roller 70.

In the present embodiment, a rubber hardness (75 degrees) of the pressure roller 70 is higher than a rubber hardness (68 degrees) of the fixing roller 60, so that the fixing nip area N, which is formed between the pressure roller 70 and the fixing roller 60, has a reverse nip shape (takes a form such that the fixing roller 60 slightly yields to pressure of the pressure roller 70 while the pressure roller 70 nearly remains its original shape). The fixing nip area N obtained in this manner has a nip width of 8.5 mm.

The reason why the fixing nip area N provided between the pressure roller 70 and the fixing roller 60 has the reverse nip shape is explained below. In cases where the fixing nip area N has the reverse nip shape, the paper sheet P that has passed through the fixing nip area N is outputted toward a direction along the outer surface of the pressure roller 70. This arrangement makes it easy for the paper sheet P to make separation by itself in outputting from the fixing nip area N. The separation is occurred by stiffness of a paper sheet without need for a forced separating aiding means such as separation claw.

On the other hand, in cases where a surface hardness of the pressure roller 70 is lower than a surface hardness of the fixing roller 60, the fixing nip area N between the fixing roller 60 and the pressure roller 70 takes a form such that the pressure roller 70 slightly yields to pressure of the fixing roller 60 while the fixing roller 60 nearly remains its original shape. This arrangement makes it difficult for the paper sheet P to make separation by itself because the paper sheet P that has passed through the fixing nip area N is outputted toward a direction along the fixing roller 60.

The external heating device 80 is made up of a first support roller 81, a second support roller 82, and an endless belt (external heating member) 83. The endless belt 83 is set over the first support rollers 81 and the second support roller 82 so that the inner surface of the endless belt 83 comes into contact with the outer surfaces of the first support rollers 81 and the second support roller 82. The first support rollers 81 and the second support roller 82 rotate opposite in direction to the rotation of the fixing roller 60 (i.e. direction indicated by an arrow K in FIG. 1). With the rotation of the first support rollers 81 and the second support roller 82, the endless belt 83 makes circulation movement in the direction indicated by the arrow K.

The endless belt 83 is a belt member which is made up of (a) a 90 μm-thick polyimide base material and (b) a 10 μm-thick PTFE release layer. The endless belt 83 has an external diameter of 30 mm. The endless belt 83 is not limited to such a belt member, and may be a belt member made of metal such as nickel, stainless steel, or iron. The external diameter of the endless belt 83 is not limited to 30 mm. A material for the endless belt 83 may be anything, provided that it is excellent in heat resistance, durability, and toner releasing property. The material for the release layer 63 may be PFA, instead of PTFE.

The first support roller 81 and the second support roller 82 are rollers each of which is realized by a shaft made of aluminum and having an external diameter of 15 mm and a thickness of 1 mm. If necessary (for example, in order to reduce deviation force of the endless belt 83 (force which causes the endless belt 83 to move in a direction perpendicular to a rotational direction) caused by travel of the endless belt 83 in a meandering manner by reducing frictional forces produced between the inner surface of the endless belt 83 and the first support roller 81 and between the inner surface of the endless belt 83 and the second support roller 82), the first support roller 81 and the second support roller 82 each may be made up of the shaft and a release layer formed on the shaft. A material for the release layer may be anything, provided that it is excellent in heat resistance, durability, and toner releasing property. The material for the release layer can be fluorine material such as PFA or PTFE (polytetrafluoroethylene).

The first support roller 81 and the second support roller 82 are pressed against the outer surface of the fixing roller 60 by an elastic member (spring) not shown via the endless belt 83. With this arrangement, a nip area is formed between the outer surface of the endless belt 83 and the outer surface of the fixing roller 60, and the outer surface of the endless belt 83 comes into contact with the outer surface of the fixing roller 60. A nip width between the outer surface of the endless belt 83 and the outer surface of the fixing roller 60 is 20 mm (width along a circumference of the fixing roller 60).

Note that in the external heating device 80, the outer surface of the endless belt 83 is in contact with a thermistor (temperature control means; first temperature sensor) 85 that detects a temperature on the outer surface of the endless belt 83. Inside the first support roller 81 provided is a halogen lamp (temperature control means; first heat source device) 86 that heats in response to power supply to the halogen lamp 86. The halogen lamp 86 is a heat source of the endless belt 83. When power is supplied to the halogen lamp 86, the halogen lamp 86 radiates heat, which heats the endless belt 83 via the first support roller 81. Since the endless belt 83 is a belt that is provided outside the fixing roller 60 and in contact with the outer surface of the fixing roller 60, the endless belt 83 heats the fixing roller 60 through such a contacting part.

In the present embodiment, the endless belt 83 is set over the two support rollers. However, the endless belt 83 may be set over three or more rollers which include a tension roller additionally provided, if necessary (This is because there is a limit to the extent to which only two support rollers can support the endless belt so that a wide nip width between the fixing roller 60 and the endless belt 83 is secured, for example.).

A heat source control device (temperature control means) 90 is a control integrated circuit substrate which controls a temperature of the surface of the endless belt 83, a temperature of the outer surface of the fixing roller 60, and a temperature of the outer surface of the pressure roller 70.

More specifically, the heat source control device 90 is connected to the thermistors 65, 75, and 85. The heat source control device 90 controls power supply to the halogen lamps 64 and 86 so that a temperature detected by the thermistor 85 (surface temperature of the endless belt 83) reaches a control temperature T1, and a temperature detected by the thermistor 65 (outer surface temperature of the fixing roller 60) becomes a control temperature T2. In other words, the heat source control device 90 controls on/off of the halogen lamps 64 and 86 and also controls the amount of power supply to the halogen lamps 64 and 86 being on, thereby controlling a surface temperature of the endless belt 83 and an outer surface temperature of the fixing roller 60.

The heat source control device 90 controls power supply to the halogen lamp 74 so that a temperature detected by the thermistor 75 (outer surface temperature of the pressure roller 70) reaches a control temperature T3. In other words, the heat source control device 90 controls on/off of the halogen lamp 74 and also controls the amount of power supply to the halogen lamp 74 being on, thereby controlling a surface temperature of the pressure roller 70.

In the present embodiment, as shown in Table 1, the heat source control device 90 selects the control temperature T1 (first setting temperature), the control temperature T2 (second setting temperature), and the control temperature T3 in accordance with operative condition of the image forming apparatus 1. Further, as shown in Table 2, the heat source control device 90 selects the amount of power supply to each of the halogen lamps 64, 74, and 86 when they are turned on, in accordance with operative condition of the image forming apparatus 1.

TABLE 1

| | | Control temperature T1 (Endless belt) | Control temperature T2 (Fixing roller) | Control temperature T3 (Pressure roller) |
|---|---|---|---|---|
| Standby condition | | 170° C. | 170° C. | 140° C. |
| Recording material passing condition | 350 mm/s (Monochrome mode) | 210° C. | 190° C. | — |
| | 170 mm/s (Color mode) | 190° C. | 170° C. | — |

TABLE 2

| | | Halogen lamp 86 (Endless belt) | Halogen lamp 64 (Fixing roller) | Halogen lamp 74 (Pressure roller) |
|---|---|---|---|---|
| Standby condition | | 300 W | 200 W | 200 W |
| Recording material feeding Condition | 350 mm/s (Monochrome mode) | 1000 W | 0 W when halogen lamp 86 is ON<br>1000 W when halogen lamp 86 is OFF | Always OFF |
| | 170 mm/s (Color mode) | 600 W | 400 W | Always OFF |

In the color mode under the recording material passing condition (fixing process operation), and under the standby condition, the heat source control device 90 controls the halogen lamps 64 and 86 as follows. The heat source control device 90 turns on the halogen lamp 86 when a temperature detected by the thermistor 85 is below the control temperature T1, and turns off the halogen lamp 86 when a temperature detected by the thermistor 85 is equal to or higher than the control temperature T1. The heat source control device 90 turns on the halogen lamp 64 when a temperature detected by the thermistor 65 is below the control temperature T2, and turns off the halogen lamp 64 when a temperature detected by the thermistor 65 is equal to or higher than the control temperature T2.

In the monochrome mode under the recording material passing condition, the heat source control device 90 controls the halogen lamps 64 and 86 as follows. In the monochrome mode, the heat source control device 90 turns on the halogen lamp 86 when a temperature detected by the thermistor 85 is below the control temperature T1, and turns off the halogen lamp 86 when a temperature detected by the thermistor 85 is equal to or higher than the control temperature T1. In the monochrome mode, the heat source control device 90 sets the amount of power supply to the halogen lamp 64 to 0 W (i.e. turns off) while the halogen lamp 86 is turned on. On the other hand, the heat source control device 90 turns on the halogen lamp 64 while halogen lamp 86 is turned off. In the monochrome mode, the halogen lamps 64 and 86 are controlled as described above, so that a surface temperature of the endless belt 83 can be controlled to be near the control temperature T1, and that an outer surface temperature of the fixing roller 60 can be near the control temperature T2 (When the fixing roller 60 is heated by the endless belt 83 which is controlled to have near-control temperature T1, an outer surface temperature of the fixing roller 60 becomes near the control temperature T2.).

Under the recording material passing condition, the heat source control device 90 constantly turns off the halogen lamp 74. Accordingly, the settings of the control temperature T3 is not carried out under the recording material passing condition as shown in Table 1. Besides, the settings of the amount of power supply to the halogen lamp 74 is not carried out under the recording material passing condition as shown in Table 2.

In the present embodiment, as shown in Table 1, when the operative condition is shifted from the standby condition to the recording material feeding condition, the heat source control device 90 changes a value of the control temperature T1 depending upon whether the color mode or the monochrome mode is selected. In other words, the heat source control device 90 changes a value of the control temperature T1 in accordance with a transport speed of the paper sheet P under the recording material feeding condition. It should be noted that at the time when the operative condition is shifted from the standby condition to the recording material feeding condition, the heat source control device 90 receives information indicative of the color mode or monochrome mode from the control section, and selects a value of the control temperature T1 in accordance with the received information.

According to such an arrangement, when the operative condition is shifted to the recording material feeding condition, a temperature of the endless belt 83 is changed in accordance with a transport speed of the paper sheet P by the heat source control device 90, the halogen lamp 86, and the thermistor 85. Accordingly, an outer surface temperature of the fixing roller 60 in contact with the endless belt 83 can be changed in accordance with the transport speed. This makes it possible to quickly change, upon selection of the transport speed, an outer surface temperature of the fixing roller 60 to a temperature at which less offset phenomena occur at a selected transport speed (i.e. control temperature T2), thereby suppressing the occurrence of the offset phenomena.

Figure 5:
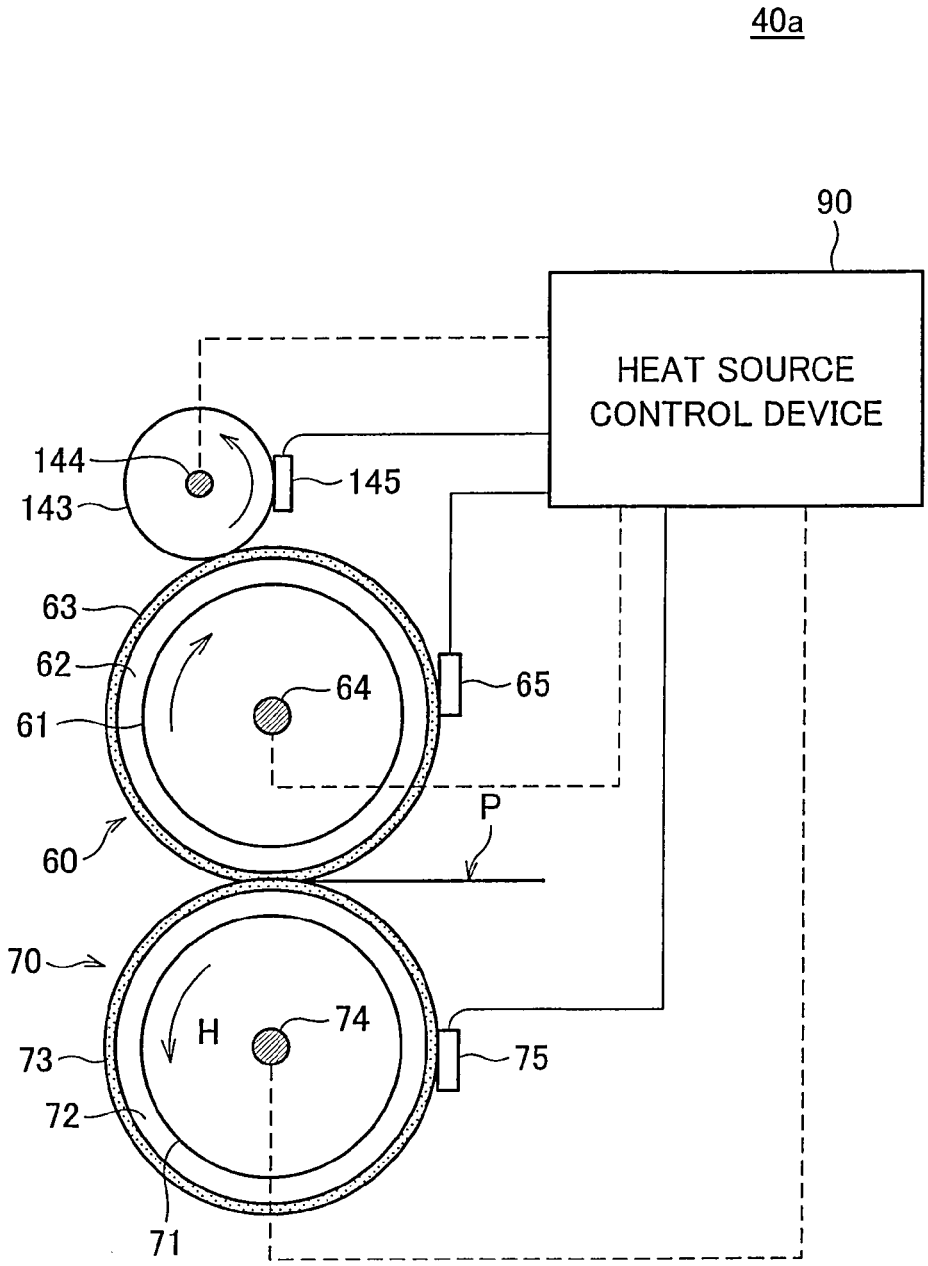
FIG. 5 is a diagram schematically illustrating the structure of a fixing apparatus that includes an external heating roller, instead of the endless belt, as an external heating member.

In the present embodiment, an external heating member which heats the outer surface of the fixing roller 60 is the endless belt 83 rather than the external heating roller 143 (see FIG. 5). A temperature of the endless belt 83 easily rises in a short time since the endless belt 83 has a lower heat capacity than the external heating roller 143. This makes it possible to quickly change the outer surface temperature of the fixing roller 60 which is in contact with the endless belt 83 and to quickly change the outer surface temperature of the fixing roller 60 in accordance with a selected transport speed. Moreover, since the endless belt 83 can secure a larger nip width with respect to the outer surface of the fixing roller 60 than the external heating roller 143, the endless belt 83 is more excellent in heat conductivity with respect to the outer surface of the fixing roller 60 than the external heating roller 143. By using the endless belt 83, it is possible to more quickly and easily perform control of the outer surface temperature of the fixing roller 60.

As shown in Table 1, in the monochrome mode where a transport speed is 350 mm/s, the control temperature T1 is 210° C. In the color mode where a transport speed is 170 mm/s, the control temperature T1 is 190° C. Thus, the surface temperature of the endless belt 83 increases with increase of the transport speed, and thus increases the outer surface of the fixing roller 60. With this arrangement, it is possible to suppress cold offset caused by a high-speed transport in the monochrome mode and to suppress hot offset caused by a low-speed transport in the color mode.

Generally, a four drum tandem engine image forming apparatus has an advantage that a sheet transport speed is adjusted to be higher in the monochrome mode than in the color mode, so that the number of paper sheets processed per unit of time can be increased in the monochrome mode. However, the four drum tandem engine image forming apparatus has a disadvantage that the offset phenomena that can come from switching of the sheet transport speed is likely to occur in the fixing process. On the contrary, the image forming apparatus 1 of the present embodiment can quickly change an outer surface temperature of the fixing roller 60 to an optimum temperature for operation at a transport speed of the paper sheet P (i.e. temperature at which less offset phenomena occurs). Thus, the image forming apparatus 1 can suppress the offset phenomena that come from switching of the transport speed and enjoy the advantage of the four drum tandem engine image forming apparatus without causing the disadvantage of the four drum tandem engine image forming apparatus.

In cases where the external heating roller 143 (see FIG. 5) is used as the external heating member that heats the outer surface of the fixing roller 60, a temperature of the external heating roller 143 must be higher than that of the fixing roller 60 under the standby condition. This is because a temperature of the external heating roller 143 does not quickly rise concurrently with the shift from the standby condition to the recording material passing condition due to a high heat capacity of the external heating roller 143. However, with such an arrangement, under the standby condition, there occurs local overheating in only a part of the outer surface of the fixing roller 60 in contact with the external heating roller 143. Then, after the shift to the recording material passing condition, there occurs a high-temperature offset at a position on the paper sheet P where the paper sheet P comes into contact with the local overheating part of the fixing roller 60 (hereinafter referred to as "partial offset"). In order to suppress the partial offset, the external heating roller 143 should be kept away from the fixing roller 60 under the standby condition and the external heating roller 143 should be brought into contact with the fixing roller 60 only under the recording material passing condition. This arrangement, however, needs a separation/contact switching mechanism for switching between a contact state and a separation state of the external heating roller 143 and the fixing roller 60, which leads to a complicated structure of the fixing apparatus.

On the contrary, in the present embodiment, the endless belt 83 whose temperature can rise in a short time is used as the external heating member that heats the outer surface of the fixing roller 60. This allows a temperature of the endless belt 83 to instantly rise concurrently with the shift from the standby condition to the recording material passing condition, even when the control temperature T1 of the endless belt 83 is subjected to a low setting to some extent under the standby condition. In view of this, in the present embodiment, while the endless belt 83 and the fixing roller 60 are always brought into contact with each other, the control temperature T1 of the endless belt 83 and the control temperature T2 of the fixing roller 60 are set to an identical value (170° C.), as shown in Table 1, under the standby condition where the image forming operation is not performed by the image forming apparatus 1, so that a temperature of the endless belt 83 and an outer surface temperature of the fixing roller 60 are controlled to be identical. This suppresses local overheating in only a part of the outer surface of the fixing roller 60 in contact with the endless belt 83, and thus prevents the occurrence of the partial offset, after the shift to the recording material passing condition, at a position on the paper sheet P where the paper sheet P comes into contact with the local overheating part of the fixing roller 60. Besides, it is not necessary to arrange the aforementioned separation/contact switching mechanism.

Furthermore, if a temperature detected by the thermistor 85 (temperature of the endless belt 83) does not reach the control temperature T1 at the time when the operative condition is shifted to the monochrome mode under the recording material passing condition, the heat source control device 90 sets the amount of power supply to the halogen lamp 64 to 0 W (i.e. turns off the halogen lamp 64) so that all the power that is allocated to the fixing apparatus 40 is supplied to only the halogen lamp 86. In other words, power supply to the halogen lamp 86 overrides power supply to the halogen lamp 64.

In this manner, all the power that is allocated to the fixing apparatus 40 (1000 W) can be concentrated on the halogen lamp 86, so that a surface temperature of the endless belt 83 can rise to the control temperature T1 (210° C.) more quickly. With this arrangement, even in the monochrome mode where the control temperature T1 is set to a high temperature of 210° C., the surface temperature of the endless belt 83 and the outer surface temperature of the fixing roller 60 can be increased quickly immediately after the shift from the standby condition to the monochrome mode. Thus, a first copy time (time interval between when the image forming apparatus 1 comes out of the standby condition and when a first paper sheet is outputted) can be accelerated in the monochrome mode.

Figure 4:
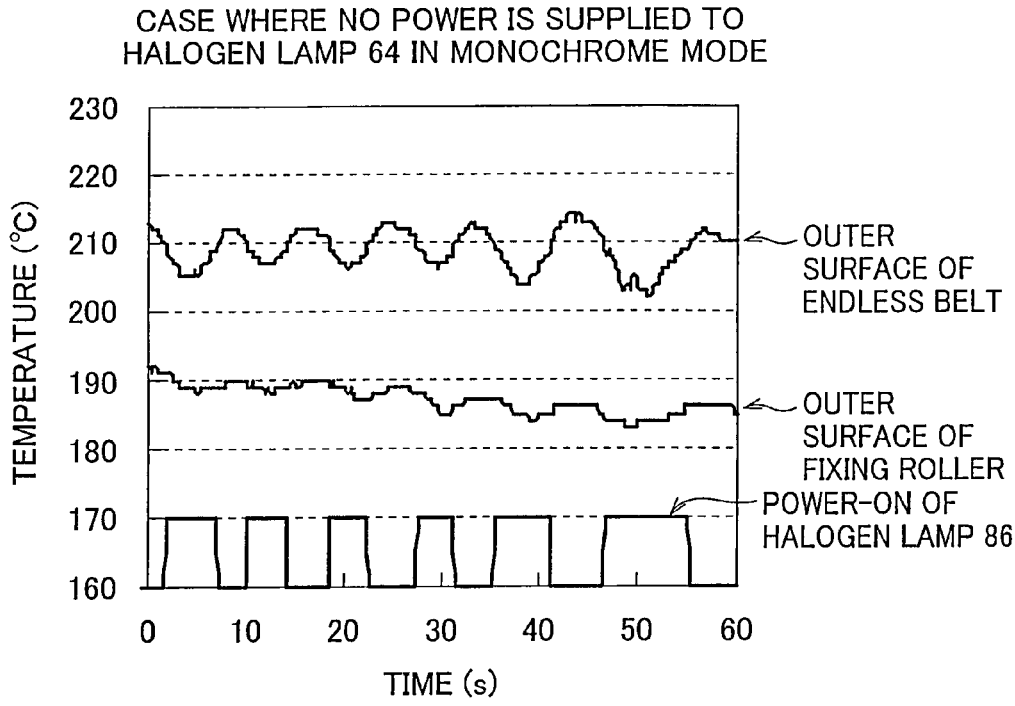
FIG. 4(*a*) is a graph illustrating temperature progression of the fixing roller and the endless belt in the monochrome mode in cases where power supply to a halogen lamp provided inside the fixing roller is not performed at all.
Figure 4:
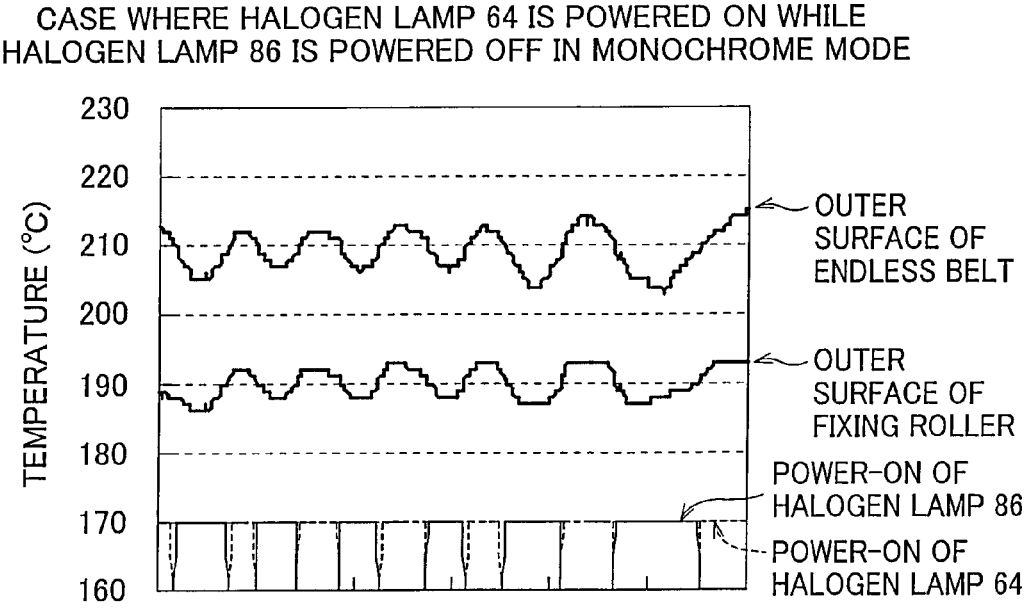

In the monochrome mode, since all the power that is allocated to the fixing apparatus 40 (1000 W) is concentrated on the halogen lamp 86, heating by the halogen lamp 64 provided inside the fixing roller 60 is not carried out at all. This leads to cooling inside the fixing roller 60 and increase in the amount of heat transfer from the outer surface of the fixing roller 60 to the inside of the fixing roller 60, thus decreasing a speed at which the outer surface temperature of the fixing roller 60 approaches the outer surface temperature of the endless belt 83. Assume that only the halogen lamp 86 is controlled, and no power is supplied to the halogen lamp 64 in the monochrome mode, as illustrated in FIG. 4(*a*). In this case, the outer surface temperature of the fixing roller 60 gradually decreases with time, and the outer surface temperature of the fixing roller 60 considerably falls below the control temperature T2. Moderate heating from the inside of the fixing roller 60 is therefore needed.

In view of this, in the present embodiment, by using power that has become available due to stop of power supply to the halogen lamp 86 during the time in which a temperature detected by the thermistor 85 (temperature of the endless belt 83) reaches the control temperature T1 in the monochrome mode, power (1000 W) is supplied to the halogen lamp 64 so that the inside of the fixing roller 60 is heated.

In other words, during the time in which a temperature detected by the thermistor 85 reaches the control temperature T1 in the monochrome mode, the heat source control device 90 stops power supply to the halogen lamp 86 and supplies power to the halogen lamp 64. With this arrangement, the inside of the fixing roller 60 is heated moderately. This makes heat on the outer surface of the fixing roller 60 hard to transfer to the inside of the fixing roller 60, and suppresses a quick cooling of the outer surface of the fixing roller 60. Thus, as illustrated in FIG. 4(*b*), the outer surface temperature of the fixing roller 60 can be held at a temperature that is close to the control temperature T2 for a longer period of time.

In the present embodiment, the endless belt 83 whose temperature can rise quickly is used as the external heating member. However, the external heating member of the present invention is not limited to the endless belt 83. As is the case with the fixing apparatus 40*a* illustrated in FIG. 5, the external heating member of the present invention may be the external heating roller 143 that comes into contact with the fixing roller 60. This is because it is possible to change the surface temperatures of the external heating roller 143 and the fixing roller in accordance with switching of a transport speed even in the arrangement illustrated in FIG. 5, with the arrangement in which the heat source control device 90 selects a control temperature of the halogen lamp 144 inside the external heating roller 143 in accordance with a transport speed of the paper sheet P. However, since the external heating roller 143 illustrated in FIG. 5 is higher in heat capacity than the endless belt 83, a temperature of the external heating roller 143 cannot rise as quickly as a temperature of the endless belt 83. Hence, under the standby conditions, a temperature of the external heating roller 143 must be set to be higher to some extent than that of the fixing roller 60. Further, the foregoing separation/contact switching mechanism is necessary to suppress the partial offset.

The following will briefly describe the structure of the fixing apparatus 40*a* illustrated in FIG. 5. The fixing apparatus 40*a* illustrated in FIG. 5 includes the fixing roller 60 and the pressure roller 70, both of which are the same as the ones illustrated in FIG. 1, and further includes the external heating roller 143. The external heating roller 143 has an external diameter of 30 mm and a thickness of 3 mm, and is made up of a metal shaft that is made of aluminum and coated with PTFE around the metal shaft. Further, the external heating roller 143 is press-contacted to the outer surface of the fixing roller 60 by an elastic member (spring) not shown. This forms a nip area between the surface of the endless roller 83 and the outer surface of the fixing roller 60, and the external heating roller 143 comes into contact with the outer surface of the fixing roller 60. Note that a width of the nip between the fixing roller 60 and the external heating roller 143 is 3 mm.

On the outer surface of the external heating roller 143, a thermistor 145 that detects a temperature of the outer surface of the external heating roller 143 is in contact with the external heating roller 143. The thermistor 145 is connected to the heat source control device 90. Inside the external heating roller 143 installed is a halogen lamp 144 that performs heat radiation when power is supplied to the halogen lamp 144. The halogen lamp 144 is a heat source of the external heating roller 143. When power is supplied to the halogen lamp 144, the halogen lamp 64 heats the external heating roller 143. Since the external heating roller 143 is a roller that is provided outside the fixing roller 60 and in contact with the outer surface of the fixing roller 60, the external heating roller 143 heats the outer surface of the fixing roller 60 via such a contacting part.

Note that the image forming apparatus 1 of the present embodiment has the color mode and the monochrome mode of different transport speeds, i.e. changes a transport speed upon switching between the color mode and the monochrome mode. However, change of the transport speed is not necessarily carried out upon switching between the color mode and the monochrome mode.

For example, the image forming apparatus 1 of the present embodiment may be arranged so as to be capable of switching between (a) a high-speed processing mode where the image forming process is performed at a transport speed of 350 mm/s and (b) a low-speed processing mode where the image forming process is performed at a transport speed of 170 mm/s, in accordance with instructions entered by the user. In such an arrangement, the heat source control device 90 changes a value of the control temperature T1 according to whether the high-speed processing mode and the low-speed processing mode is selected. Even in such an arrangement, it is possible to change a temperature of the endless belt 83 in accordance with a transport speed of the paper sheet P under the recording material feeding condition.

The image forming apparatus 1 includes a scanner (not shown) which scans image data from an original document and an image processing section (not shown) which processes the scanned image data. On the basis of the image data that has been processed by the image processing section, an image corresponding to the image data is formed on the paper sheet P. In the image processing section, a document type determining process is carried out in which the type of the document (e.g. character document consists of characters and base, photographic document, and others) is determined by using the image data.

In view of this, the image forming apparatus 1 may change the sheet transport speed according to the type of the document that has been determined by the image processing section. In this case, the heat source control device 90 changes a value of the control temperature T1 according to the type of the document (For example, in the case of image formation on the paper sheet P on the basis of an image that is read from a character document, the sheet transport speed is adjusted to be a high speed since less image degradation occurs even at a high speed processing. On the other hand, in the case of image formation on the paper sheet P on the basis of an image that is read from a photograph document, the sheet transport speed is adjusted to be a low speed since image degradation is likely to occur at a high speed processing.).

Note that the above-mentioned document type determining process can be realized by a known method described in Japanese Unexamined Patent Publication No. 232708/2002. However, the document type determining process is not limited to the method described in Japanese Unexamined Patent Publication No. 232708/2002. The following will briefly describe the steps of the document type determining process.

Pixels in the image data that has been read from the document are sequentially dealt as object pixels. Each block that consists of n pixels by m pixels including the object pixel at the center thereof is subjected to the following steps (1) through (6):

(1) Calculate a minimum density value and a maximum density value.

(2) Calculate a maximum density difference from the thus calculated minimum density value and maximum density value.

(3) Calculate a total density complexity that is a sum of absolute values of the density differences between adjacent pixels.

(4) Compare the thus calculated maximum density difference with a threshold value of maximum density difference, and compare the thus calculated total density complexity with a threshold value of total density complexity. If the results of the comparisons satisfy the following conditions: maximum density difference<threshold value of maximum density difference and total density complexity<threshold value of total density complexity, the object pixel is determined as base/photograph pixel. If the results of the comparisons do not satisfy the above conditions, the object pixel is determined as character/halftone pixel.

(5) Regarding the object pixel that has been determined as base/photograph pixel, compare the maximum density difference with a threshold value of base/photograph determination. If the result of the comparison satisfy the following condition: maximum density difference<threshold value of base/photograph determination, the object pixel is determined as base pixel. If the result of the comparison does not satisfy the above condition, the object pixel is determined as photograph pixel.

(6) Regarding the object pixel that has been determined as character/halftone pixel, compare the total density complexity with a multiplication value obtained by multiplication of the maximum density difference by a threshold value of character/halftone pixel determination. If the result of the comparison satisfies the following condition: total density complexity<multiplication value, the object pixel is determined as character pixel. If the result of the comparison does not satisfy the above condition, the object pixel is determined as halftone pixel.

Then, photograph pixels, character pixels, halftone pixels, and base pixels are counted. Types of the documents are determined according to pixel counts thus obtained. For example, if a percentage of the character pixels relative to the total pixels are 30%, the document is determined as character document. If a percentage of the photograph pixels relative to the total pixels is 10%, the document is determined as photograph document.

Example 1

The inventors of the present invention conducted an experiment to verify (a) the effect brought about by the arrangement in which control temperature of the external heating member is changed in accordance with a sheet transport speed and (b) the effect brought about by the use of the endless belt 83 as the external heating member. The experiment will be described in detail below.

In the experiment, test printing was carried out, using the fixing apparatus 40 illustrated in FIG. 1, changing the control temperature T1 of the endless belt 83 depending on whether the monochrome mode (transport speed of 350 mm/s) or the color mode (transport speed of 170 mm/s) is selected. Note that temperature control of the fixing apparatus 40 was carried out under the conditions shown in Tables 1 and 2, and operative conditions of the image forming apparatus 1 in the color and monochrome modes were as follows:

(A) Color Mode

Continuous sheet feeding was carried out to form a solid image on each paper sheet. The sheet transporting means of the image forming apparatus 1 was controlled so that a first paper sheet P passed through the outer surface of the fixing roller 60 about 2.8 seconds after the image forming apparatus 1 had come out of the standby condition.

(B) Monochrome Mode

Continuous sheet feeding was carried out to form a solid image on each paper sheet. The sheet transporting means of the image forming apparatus 1 was controlled so that a first paper sheet P passed through the outer surface of the fixing roller 60 at the time when a temperature of the outer surface of the fixing roller 60 reached 190° C. after the image forming apparatus 1 had come out of the standby condition.

Figure 3:
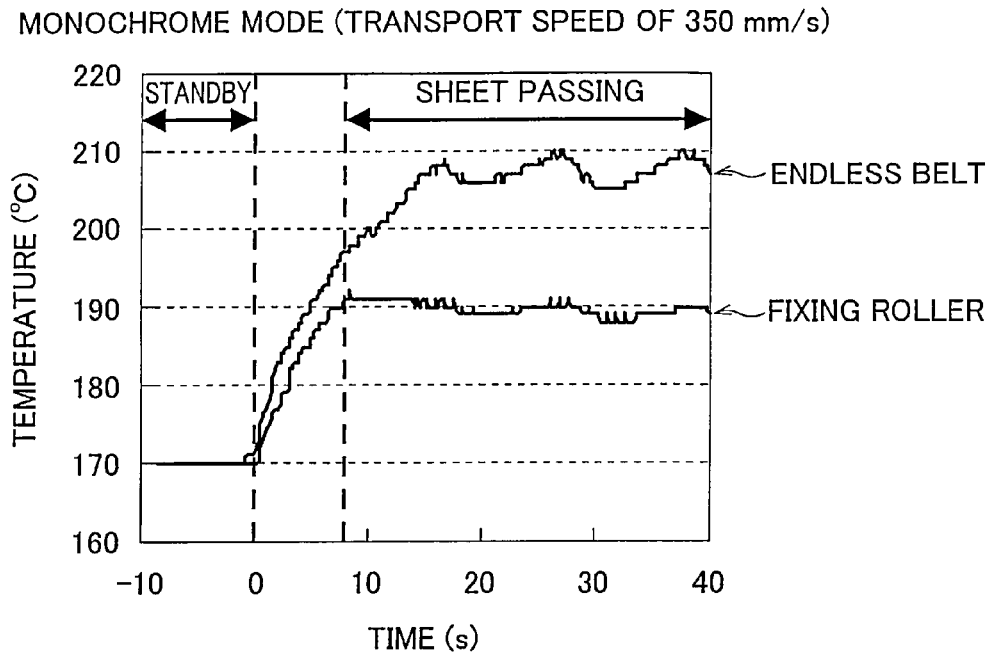
FIG. 3(*a*) is a graph illustrating the temperature progression of a fixing roller and an endless belt of the fixing apparatus illustrated in FIG. 1 in a monochrome mode.
Figure 3:
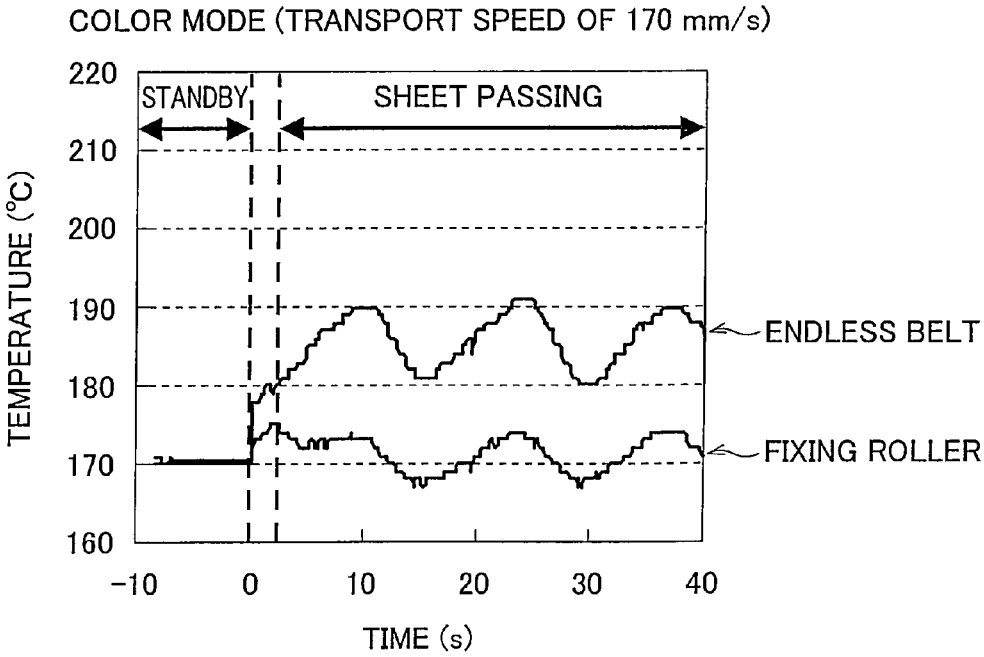

The operations were carried out in the color mode and the monochrome mode under the above conditions. In the monochrome mode, a temperature of the endless belt 83 and a temperature of the outer surface of the fixing roller 60 progressed as illustrated in FIG. 3(*a*). In color mode, a temperature of the endless belt 83 and a temperature of the outer surface of the fixing roller 60 progressed as illustrated in FIG. 3(*b*).

As illustrated in FIG. 3(*a*), in cases where continuous sheet feeding was carried out in the monochrome mode where a transport speed is 350 mm/s, a temperature of the outer surface of the fixing roller 60 remains about the control temperature T2 (190° C.). As illustrated in FIG. 3(*b*), in cases where continuous sheet feeding was carried out in the color mode where a transport speed is 170 mm/s, a temperature of the outer surface of the fixing roller 60 remains about the control temperature T2 (170° C.).

Next, the inventors of the present invention evaluated fixing of an image formed on the paper sheet upon continuous sheet feeding in the color mode and continuous sheet feeding in the monochrome mode. The evaluation was carried out as follows. After a printed paper sheet was slightly folded with its print side inward, a folded part of the printed paper sheet was pressed under a predetermined load. The image fixing was evaluated by a width of the toner that comes off the folded part (width of toner in a perpendicular direction with respect to the folded part). The result of the evaluation is shown in Table 3.

TABLE 3

| Continuously fed sheet counts | 1 to 9 | 10 to 19 | 20 to 30 |
|---|---|---|---|
| 350 mm/s (Monochrome mode) | ◎ | ◎ | ◎ |
| 170 mm/s (Color mode) | ◎ | ◎ | ◎ |

◎: Extremely High fix level

Under temperature control of the fixing apparatus 40 under the conditions shown in Tables 1 and 2, more specifically, in cases where a control temperature of the external heating member was changed in accordance with the sheet transport speed, and the endless belt 83 was used as the external heating member, image formation was carried out in high fix level throughout the sheet passing regardless of the monochrome mode and the color mode, as shown in Table 3.

Example 2

Comparative experiment was carried out for more specific study on the result of Example 1. In the comparative experiment, test printing was carried out, using the fixing apparatus 40*a* (see FIG. 5) that includes the external heating roller 143 and keeping a control temperature of the external heating roller 143 at a constant temperature in the monochrome mode (transport speed of 350 mm/s) and the color mode (transport speed of 170 mm/s). Then, comparison between the result of the test printing and the result of Example 1 was made. Temperature control of the fixing apparatus 40*a* was carried out under the conditions shown below in Tables 4 and 5, operative conditions of the image forming apparatus 1 in the monochrome mode and the color mode were as in the aforementioned (A) and (B).

TABLE 4

| | | Control temperature T1 (Endless belt) | Control temperature T2 (Fixing roller) | Control temperature T3 (Pressure roller) |
|---|---|---|---|---|
| Standby conditions | | 220° C. | 170° C. | 140° C. |
| Recording material feeding conditions | 350 mm/s (Monochrome mode) | 220° C. | 190° C. | — |
| | 170 mm/s (Color mode) | 220° C. | 170° C. | — |

TABLE 5

| | | Halogen lamp 144 (External heating roller) | Halogen lamp 64 (Fixing roller) | Halogen lamp 74 (Pressure roller) |
|---|---|---|---|---|
| Standby conditions | | 300 W | 200 W | 200 W |
| Recording material feeding Conditions | 350 mm/s (monochrome mode) | 400 W | 600 W | Always OFF |
| | 170 mm/s (color mode) | 600 W | 400 W | Always OFF |

In Table 4, control temperature T1' is a control temperature of the external heating roller 143. In the present comparative experiment, the control temperature T1' was kept constant both in the standby condition and the recording material passing condition.

Figure 6:
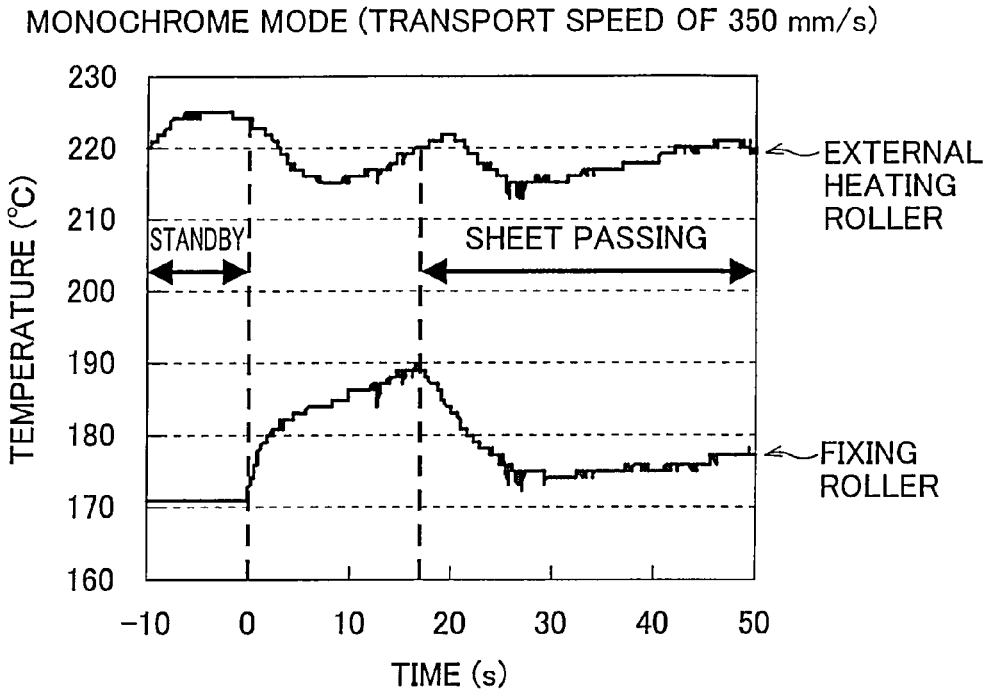
FIG. 6(*a*) is a graph illustrating temperature progression of the fixing roller and the external heating roller of the fixing apparatus illustrated in FIG. 5 in the monochrome mode.
Figure 6:
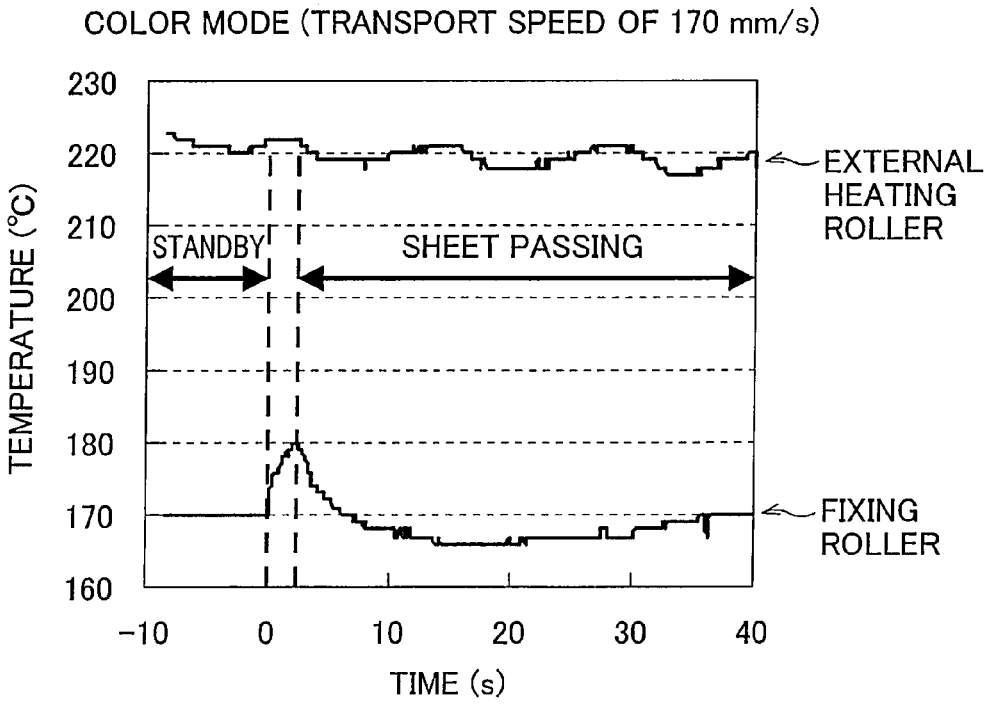

In cases where the operations were carried out in the color mode and the monochrome mode under the above conditions, an outer surface temperature of the external heating roller 143 and an outer surface temperature of the fixing roller 60 progressed in the monochrome mode, as illustrated in FIG. 6(*a*). In the color mode, an outer surface temperature of the external heating roller 143 and an outer surface temperature of the fixing roller 60 progressed as illustrated in FIG. 6(*b*).

In the monochrome mode, as illustrated in FIG. 6(*a*), the outer surface of the fixing roller 60 reached control temperature T2 (190° C.) about 17 seconds after the image forming apparatus 1 had come out of the standby condition. Thereafter, when continuous sheet passing was carried out, an outer surface temperature of the fixing roller 60 fell below the control temperature T2 (190° C.), and dropped to 174° C. (hereinafter, such a temperature drop is referred to as "undershoot").

The undershoot occurs because heat is not efficiently supplied from the external heating roller 143 to the outer surface of the fixing roller 60 due to only 3 mm wide nip formed between the external heating roller 143 and the fixing roller 60.

In Example 1, the amount of power supply to the halogen lamp 86 in the monochrome mode is 1000 W (see Table 2). In the test printing in Example 2, as shown in Table 5, the amount of power supply to the halogen lamp 144 in the monochrome mode is 400 W. The reason for this comes from the fact that when the amount of power supply to the halogen lamp 144 was set to 1000 W in the fixing apparatus 40*a*, the external heating roller 143 was heated to a predetermined temperature, but undershoot of the fixing roller 60 became much larger.

Evaluation of the test printing in Example 2 is shown in Table 6. In the monochrome mode, fixing performance degraded with increase in the number of paper sheets fed. Regarding a fifth fed paper sheet (at the time when the fixing roller is at 180° C. or higher temperature), fixing with low fix level was recognized. Regarding a sixth fed paper sheet and subsequent paper sheets, toner image did not fix thereon. Regarding an eighth fed paper sheet and subsequent paper sheets, a temperature of the fixing roller 60 fell below 180° C., and cold offset occurred.

TABLE 6

| | Continuously fed sheet counts | | | | |
|---|---|---|---|---|---|
| | 1 | 2 | 3 to 5 | 6 to 7 | 8 to 30 |
| 350 mm/s (Monochrome mode) | ◎ | ◎ | ○ | Δ | x |
| 170 mm/s (Color mode) | xx | ◎ | ◎ | ◎ | ◎ |

◎ Extremely high fix level
○: Low fix level but acceptable
Δ: No cold offset but unacceptable
x: Cold offset
xx: Hot offset In the color mode of the test printing of Example 2, as illustrated in FIG. 6(*b*), an outer surface temperature of the fixing roller 60 instantaneously rose to 180° C. after the image forming apparatus 1 had come out of the standby condition, and thereafter remained around control temperature T2 (170° C.). In the color mode, as shown in Table 6, partial hot offset (partial offset) occurred on a first fed paper sheet. The partial offset was caused by local overheating only in a part of the outer surface of the fixing roller 60 in contact with the external heating roller 143 due to the control temperature T1' of the external heating roller 143 higher than the control temperature T2 of the fixing roller 60 under the standby condition (see Table 4). In order to suppress the partial offset in the fixing apparatus 40*a* of FIG. 5, the external heating roller 143 should be kept away from the fixing roller 60 under the standby condition, and the external heating roller 143 should be brought into contact with the fixing roller 60 only under the recording material passing condition. This arrangement, however, needs a separation/contact switching mechanism for switching between a contact state and a separation state of the external heating roller 143 and the fixing roller 60, which leads to a complicated structure of the fixing apparatus 40*a*.

Furthermore, in order to suppress the partial offset without provision of the separation/contact switching mechanism, the control temperature T1' of the external heating roller 143 must be set to be the same (170° C.) as the control temperature of the fixing roller 60 under the standby condition as in the fixing apparatus 40 of FIG. 1. Such a setting in the fixing apparatus 40*a* of FIG. 5 makes it impossible to raise a temperature the external heating roller 143 instantaneously from 170° C. to 220° C. at the sheet passing in the monochrome mode.

This is because the external heating roller 143 has a large heat capacity, unlike the endless belt 83. Therefore, it is difficult to raise a temperature of the external heating roller 143 instantaneously.

The external heating roller 143 has a large heat capacity because the external heating roller 143 is designed to have a thickness of 3 mm or greater (In order to ensure a width of the nip between the secure external heating roller 143 and the fixing roller 60, a load of approximately 20 kgf must be imposed on the external heating roller 143. In order to prevent the external heating roller 143 from becoming deformed under the load of approximately 20 kgf, a thickness of the external heating roller 143 must be 3 mm or greater.).

On the other hand, when a heat capacity of the external heating roller 143 is decreased by reduction of a thickness of the external heating roller 143, it is impossible to ensure a sufficient width of the nip between the external heating roller 143 and the fixing roller 60. This makes it impossible for the external heating roller 143 to efficiently heat the fixing roller 60. Thus, it takes more time to cause a temperature of the fixing roller 60 to reach 190° C. from 170° C. In other words, there exists a trade-off where a heat capacity of the external heating roller 143 increases with increase in thickness of the external heating roller 143, but reduction in thickness of the external heating roller 143 makes it impossible to ensure a width of the nip between the external heating roller 143 and the fixing roller 60.

Next, comparison between the test result of Example 1 and the test result of Example 2 is made. In the case of continuous sheet passing in the monochrome mode, the time required for rise in temperature of the outer surface of the fixing roller from 170° C. to 190° C. was about 17 seconds in Example 2 and about 8 seconds in Example 1. According to the arrangement of Example 1, it is possible to reduce the first copy time.

In the case of continuous sheet feeding in the monochrome mode, cold offset occurs due to undershoot of a temperature of the fixing roller 60 in Example 2. On the other hand, in Example 1, a temperature of the fixing roller 60 stably hovers around 190° C. and no undershoot occurs.

In the case of continuous sheet feeding in the color mode, hot offset occurred on a first fed paper sheet in Example 2 since the control temperature T1' of the external heating roller 143 must have been set to 220° C. under the standby condition. On the other hand, in Example 1, no hot offset occurred on a first fed paper sheet since it is possible to set the control temperature T1 of the endless belt 83 to be the same as the control temperature T2 of the fixing roller 60 under the standby condition.

Example 3

The external heating device 80 which is included in the fixing apparatus 40 illustrated in FIG. 1 has the first support roller 81 and the second support roller 82 around a nip area between the fixing roller 60 and the endless belt 83. The first support roller 81 is disposed upstream with respect to a driving direction of the endless belt 83. The second support roller 82 is disposed downstream with respect to a driving direction of the endless belt 83. The halogen lamp 86, which is a heat source of the endless belt 83, is included only in the first support roller 81, but not included in the second support roller 82.

However, location and number of halogen lamps in the external heating device in FIG. 1 is not the only possibility. As in the external heating device 80*a* of FIG. 7(*a*), a halogen lamp 86*a* may be disposed inside the second support roller 82 rather than inside the first support roller 81. Alternatively, as in the external heating device 80*b* of FIG. 7(*b*), a halogen lamp 86*c* and a halogen lamp 86*d* may be disposed inside the first support roller 81 and the second support roller 82, respectively.

Figure 7:
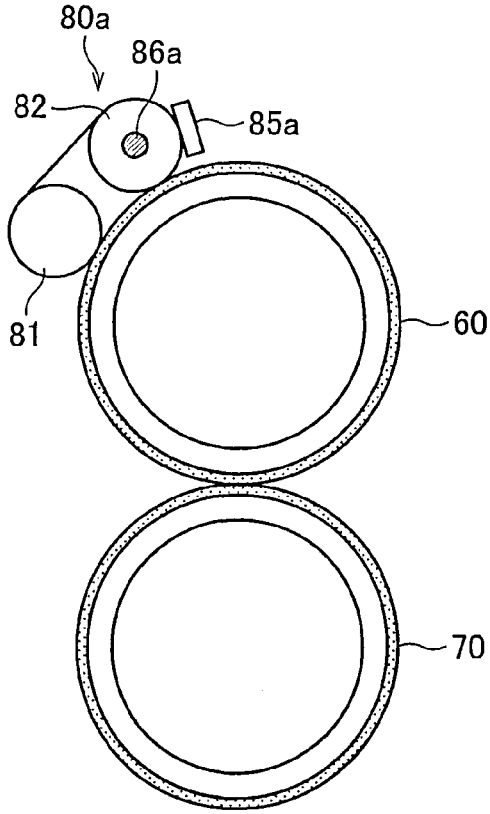
FIG. 7(*a*) is a diagram schematically illustrating the structure of a fixing apparatus in which a first support roller and a second support roller support an endless belt in a tensioned state, and only the second support roller includes a halogen lamp therein.
Figure 7:
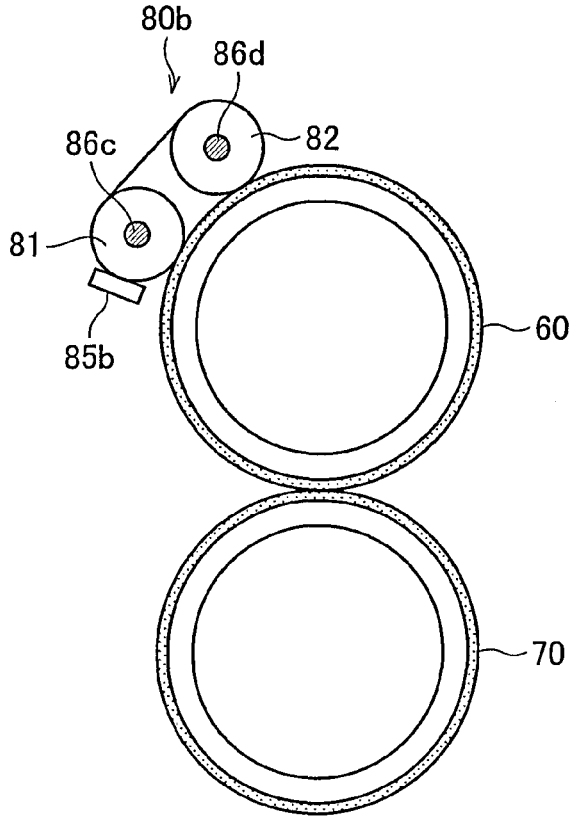

Regarding the degree of undershoot that occurs in the progression of an outer surface temperature of the fixing roller 60 during continuous sheet passing in the monochrome mode, the comparisons between the results obtained by using the external heating device 80 illustrated in FIG. 1, the external heating device 80*a* illustrated in FIG. 7(*a*), and the external heating device 80*b* illustrated in FIG. 7(*b*) were made. The following will discuss the comparisons in detail.

For the comparisons, the settings were made as follows. In the external heating device 80 illustrated in FIG. 1, a rated voltage of the halogen lamp 86 provided inside the first support roller 81 was 600 W, and the thermistor 85 was disposed on the surface of the endless belt 83 facing the first support roller 81. In the external heating device 80*a* illustrated in FIG. 7(*a*), a rated voltage of the halogen lamp 86*a* provided inside the second support roller 82 is 600 W, and the thermistor 85*a* was disposed on the surface of the endless belt 83 facing the second support roller 82. Further, in the external heating device 80*b* illustrated in FIG. 7(*b*), a rated voltage of the halogen lamp 86*c* provided inside the first support roller 81 was 300 W, a rated voltage of the halogen lamp 86*d* provided inside the second support roller 82 was 300 W (i.e. a total of 600 W), and the thermistor 85*b* was disposed on the surface of the endless belt 83 facing the first support roller 81.

For the comparisons, further settings were made as follows. Table 7 gives settings of the control temperature T1 of the endless belt 83, the control temperature T2 of the fixing roller 60, and the control temperature T3 of the pressure roller 70. With the aim of making the comparisons on the degree of undershoot that occurs in the progression of outer surface temperature of the fixing roller 60, the control temperature T1 of the endless belt 83 in the monochrome mode was set to 200° C., which is lower than the control temperature T1 shown in Table 1.

TABLE 7

| | | Control temperature T1 (Endless belt) | Control temperature T2 (Fixing roller) | Control temperature T3 (Pressure roller) |
|---|---|---|---|---|
| Standby condition | | 180° C. | 180° C. | 140° C. |
| Recording material passing condition | Monochrome mode | 200° C. | 190° C. | — |

Table 8 gives the settings of the amounts of power supply to the halogen lamp of the external heating device, the halogen lamp provided inside the fixing roller 60, and the halogen lamp provided inside the pressure roller 70.

TABLE 8

| | | Halogen lamp of external heating device | Halogen lamp of fixing roller | Halogen lamp of pressure roller |
|---|---|---|---|---|
| Standby condition | | 300 W | 300 W | 200 W |
| Recording material passing condition | Monochrome mode | 600 W | 400 W | — |

Figure 8:
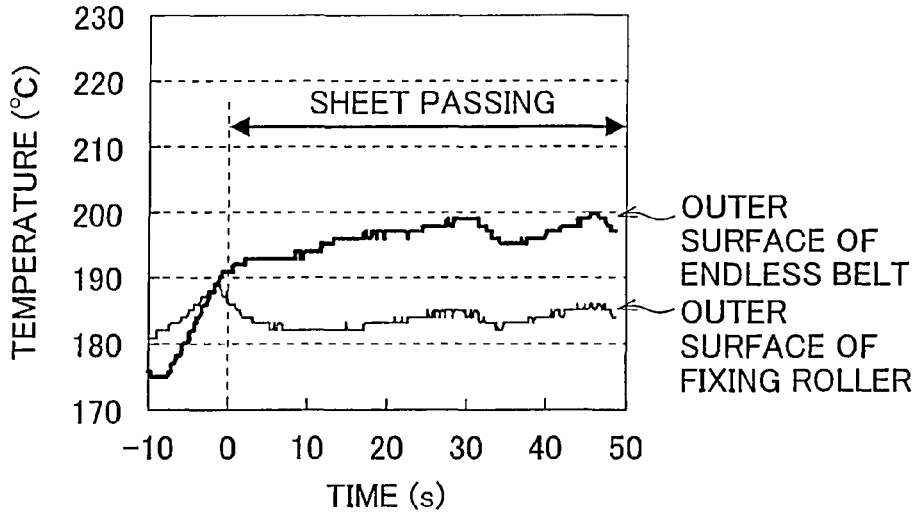
FIG. 8(*a*) is a graph illustrating temperature progression of the fixing roller and the endless belt when continuous sheet passing was performed using an external heating device illustrated in FIG. 1 in the monochrome mode.
Figure 8:
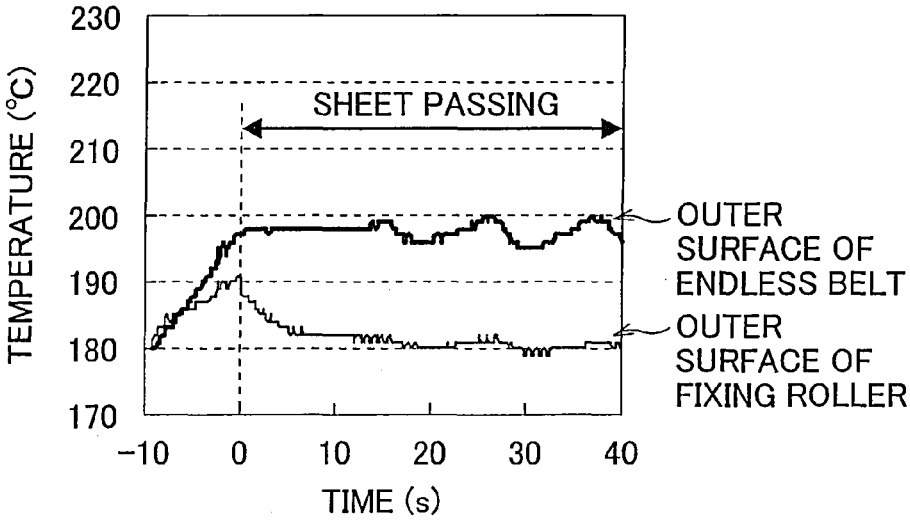
Figure 8:
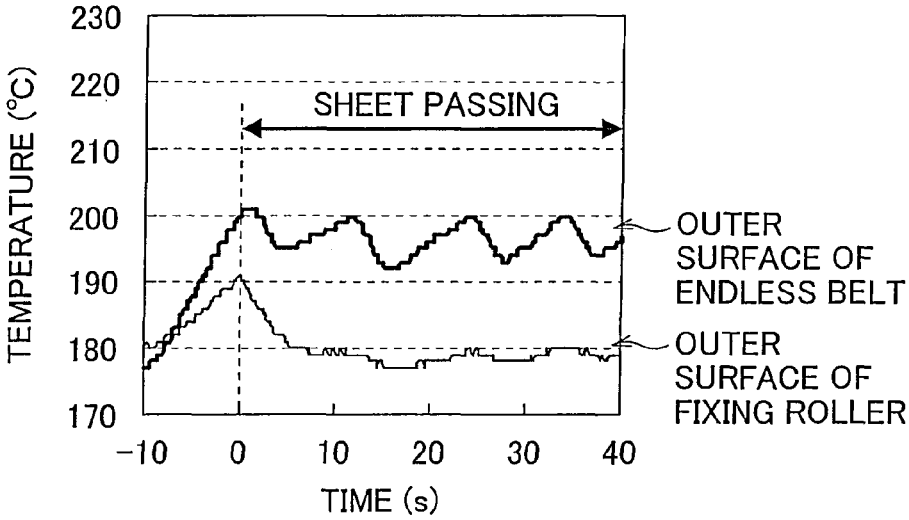

FIG. 8(*a*) is a graph illustrating the progression of the outer surface temperature of the fixing roller 60 during the continuous sheet passing in the monochrome mode with the use of the external heating device 80 illustrated in FIG. 1. FIG. 8(*b*) is a graph illustrating the progression of the outer surface temperature of the fixing roller 60 during the continuous sheet passing in the monochrome mode with the use of the external heating device 80*a* illustrated in FIG. 7(*a*). FIG. 8(*c*) is a graph illustrating the progression of the outer surface temperature of the fixing roller 60 during the continuous sheet passing in the monochrome mode with the use of the external heating device 80*b* illustrated in FIG. 7(*b*).

From the result of comparison between FIGS. 8(*a*), 8(*b*), and 8(*c*), it is apparent that the smallest undershoot occurred when the external heating device 80 illustrated in FIG. 1 was used, and the largest undershoot occurred when the external heating device 80*b* illustrated in FIG. 7(*b*) was used.

The undershoot that occurred when the external heating device 80*a* illustrated in FIG. 7(*a*) was used was smaller than the undershoot that occurred when the external heating device 80*b* illustrated in FIG. 7(*b*), but larger than the undershoot that occurred when the external heating device 80 illustrated in FIG. 1.

Thus, with the arrangement in which the halogen lamp 86 that is a heat source of the endless belt 83 is provided only in the first support roller 81 which is disposed upstream with respect to a driving direction of the endless belt 83 at the nip area between the endless belt 83 and the fixing roller 60, it is possible to effectively suppress the occurrence of undershoot during the continuous sheet feeding.

Figure 9:
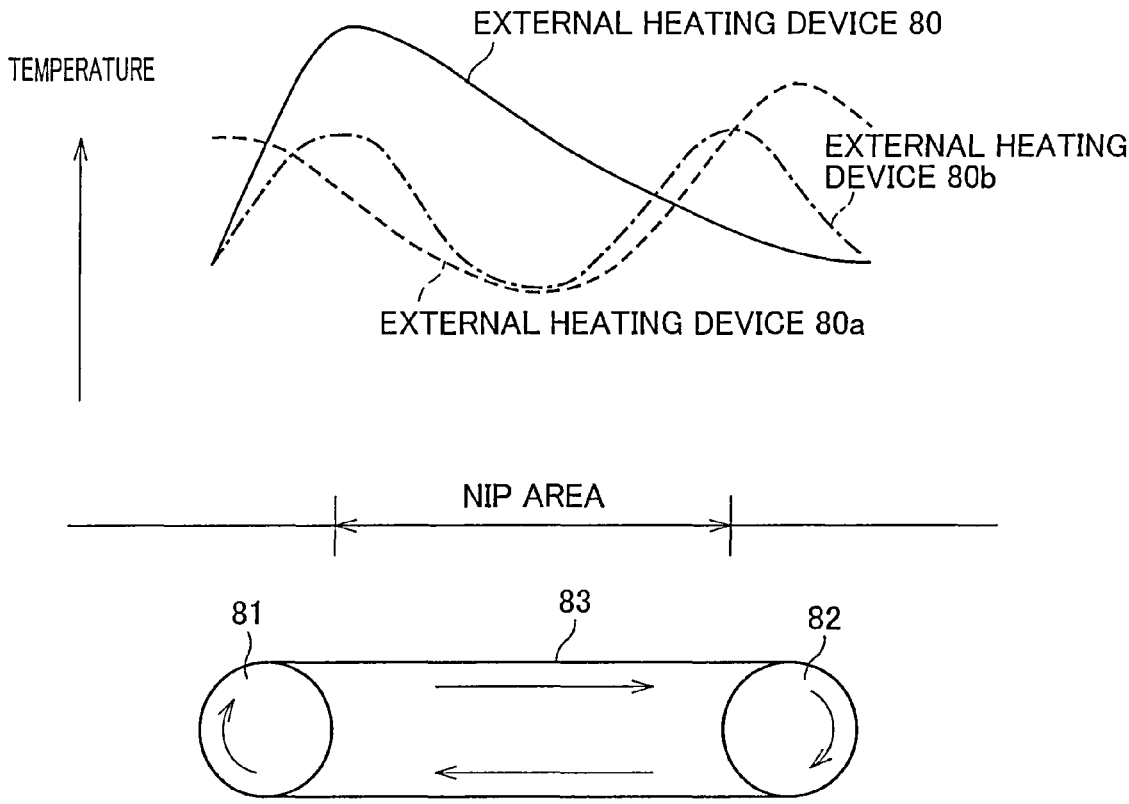
FIG. 9 is a graph illustrating distribution of surface temperature of the endless belt that is in contact with the fixing roller, when the external heating device illustrated in FIG. 1, the external heating device illustrated in FIG. 7(*a*), and the external heating device illustrated in FIG. 7(*b*) are used.

Next, the reason why the use of the external heating device 80 illustrated in FIG. 1 can effectively suppress the occurrence of undershoot will be discussed with reference to FIG. 9. FIG. 9 is a graph illustrating distributions of a temperature of the outer surface of the endless belt 83 that is in contact with the fixing roller, when the external heating device 80 illustrated in FIG. 1, the external heating device 80*a* illustrated in FIG. 7(*a*), and the external heating device 80*b* illustrated in FIG. 7(*b*) are used.

In the case of the external heating device 80*b* that includes respective halogen lamps provided in the first support roller 81 and the second support roller 82, in the temperature distribution of the endless belt 83, the endless belt 83 has the highest temperature at positions corresponding to the first and second support rollers, and has the lowest temperature at position corresponding to the nip area that locates between the first support roller 81 and the second support roller 82 (nip area between the endless belt 83 and the fixing roller 60). Thus, it is impossible to efficiently heat the outer surface of the fixing roller 60 at the position of the endless belt 83 corresponding to the nip area.

In the case of the external heating device 80*a* that includes the halogen lamp only in the second support roller 82, the endless belt 83 has the highest temperature at a position corresponding to the second support roller 82 in the temperature distribution of the endless belt 83. However, the second support roller 82 is located downstream of the nip area. Although the endless belt 83 is heated at a position corresponding to the second support roller 82, the endless belt 83 cools down until the endless belt 83 returns to a position corresponding to the nip area, which causes the endless belt 83 to have the lowest temperature at the position corresponding to the nip area in the temperature distribution of the endless belt 83. Thus, it is impossible to efficiently heat the outer surface of the fixing roller at the position of the endless belt 83 corresponding to the nip area.

On the contrary, in the case of the external heating device 80 that includes the halogen lamp 86 only in the first support roller 81, which is disposed upstream of the nip area, a temperature of the endless belt 83 decreases in the temperature distribution of the endless belt 83 as the endless belt 83 travels from upstream to downstream of the nip area between the endless belt 83 and the fixing roller 60. Therefore, the endless belt 83 does not have the lowest temperature at the position corresponding to the nip area. Thus, it is considered that it is possible to effectively heat the outer surface of the fixing roller 60 and to suppress the occurrence of undershoot.

In the arrangement in which respective halogen lamps are provided in the first support roller 81 and the second support roller 82 as in the external heating device 80*b* illustrated in FIG. 7(*b*), it is preferable that the first support roller 81 and the second support roller 82 are identical in shape, size, their constituent components, and material and size of the constituent components. In this case, a temperature of a position a where the endless belt 83 is in contact with the first support roller 81 becomes substantially the same as a temperature of a position b where the endless belt 83 is in contact with the second support roller 82. It is therefore enough to provide the thermistor 85*b* for detecting a temperature of the endless belt 83 at a position close to either the position a or the position b (i.e. a single thermistor is enough.). This makes it possible to reduce constituent thermistor counts.

However, when the first support roller 81 and the second support roller 82 are not identical in shape, size, and others in the arrangement where the first support roller 81 and the second support roller 82 include respective halogen lamps, a temperature of the position a where the endless belt 83 is in contact with the first support roller 81 becomes different from a temperature of the position b where the endless belt 83 is in contact with the second support roller 82. This requires thermistors that are provided at respective positions close to both the position a and the position b of the endless belt 83.

In the aforesaid embodiment, a fixing member in the fixing apparatus is a fixing roller, and a pressure member in the fixing apparatus is a pressure roller. However, the fixing member may be a known fixing belt, instead of the fixing roller. The pressure member may be a known pressure belt, instead of the pressure roller.

The heat source control device 90 that implements temperature control of the endless belt 83 together with the thermistor 85 and the halogen lamp 86, is realized by a control integrated circuit substrate.

However, the temperature control device 90 may be realized by software by means of a processor such as a CPU (Central Processing Unit). In this case, the temperature control device 90 includes a CPU that executes the order of a control program for realizing the aforesaid functions, ROM (Read Only Memory) that stores the control program, RAM (Random Access Memory) that develops the control program in executable form, and a storage device (storage medium), such as memory, that stores the control program and various types of data therein. With this arrangement, the object of the present invention is realized by a predetermined storage medium. The storage medium stores, in computer-readable manner, program codes (executable code program, intermediate code program, and source program) of the control program of the temperature control device 90, which is software for realizing the aforesaid functions. The storage medium is provided to the temperature control device 90. With this arrangement, the temperature control device 90 (alternatively, CPU or MPU) as a computer reads out and executes program code stored in the storage medium provided.

The storage medium may be tape based, such as a magnetic tape or cassette tape; disc based, such as a magnetic disk including a Floppy® disc and hard disk and optical disk including CD-ROM, MO, MD, DVD, and CD-R; card based, such as an IC card (including a memory card) and an optical card; or a semiconductor memory, such as a mask ROM, EPROM, EEPROM, and a flash ROM.

Further, the temperature control device 90 may be arranged so as to be connectable to a communications network so that the program code is supplied to the temperature control device 90 through the communications network. The communications network is not to be particularly limited. Examples of the communications network include the Internet, intranet, extranet, LAN, ISDN, VAN, CATV communications network, virtual private network, telephone network, mobile communications network, and satellite communications network. Further, a transmission medium that constitutes the communications network is not particularly limited. Examples of the transmission medium include (i) wired lines such as IEEE 1394, USB, power-line carrier, cable TV lines, telephone lines, and ADSL lines and (ii) wireless connections such as IrDA and remote control using infrared light, Bluetooth®, 802.11, HDR, mobile phone network, satellite connections, and terrestrial digital network. Note that the present invention can be also realized by the program codes in the form of a computer data signal embedded in a carrier wave which is embodied by electronic transmission.

The temperature control device 90 is not limited to an embodiment realized by software, and may be constituted by hardware logic. Further, the temperature control device 90 may be realized by a combination of hardware carrying out some of the processes and computing means controlling the hardware and executing software for the other processes.

In order to achieve the above object, the present invention is such that a fixing apparatus includes: a fixing roller; and a pressure roller, wherein a recording material is transported between the fixing roller and the pressure roller, so that an unfixed image formed on the recording material is fixed on the recording material under heat of the fixing roller, and the fixing apparatus further includes: an external heating member which heats the outer surface of the fixing roller by external contact with the outer surface of the fixing roller; and a temperature control section which controls a temperature of the external heating member in accordance with a transport speed of the recording material.

According to the above arrangement, a temperature of the external heating member that is in contact with the outer surface of the fixing roller can be changed in accordance with a selected speed for transport of the recording material. This makes it possible to quickly change a temperature of the outer surface of the fixing roller to an optimum temperature for operation at the selected transport speed (temperature at which less offset phenomena occur). Thus, even such an arrangement that the transport speed of the image forming apparatus is selectable brings about the effect of suppressing the occurrence of offset phenomenon.

Further, it is preferable that the external heating member is an endless belt which is set over a plurality of support rollers.

According to the above arrangement, since a belt-shaped external heating member has a heat capacity less than a roller-shaped external heating member, it is easy to raise a temperature of the external heating member in a short time. Thus, it is possible to quickly perform control of the surface temperature of the fixing roller that is in contact with the external heating member.

Further, it is preferable that the temperature control section carries out the control so that a temperature of the external heating member increases with increase in transport speed of the recording material.

According to the above arrangement, it is possible to suppress the occurrence of cold offset caused by a high-speed transport and the occurrence of hot offset caused by a low-speed transport.

Generally, an image forming apparatus has an advantage that a sheet transport speed is adjusted to be higher in a single color mode in which a single color image is formed on a recording material than in a color mode (multicolor mode) in which a multicolor image is formed on a recording material, so that the number of paper sheets processed per unit of time with the single color image can be increased in the single color mode. However, the image forming apparatus has a disadvantage that the offset phenomena that can come from switching of the sheet transport speed is likely to occur in the fixing process. On the contrary, application of the fixing apparatus of the present invention to such an image forming apparatus enables quick change of the outer surface temperature of the fixing roller to an optimum temperature for operation at the transport speed (i.e. temperature at which less offset phenomena occur). Thus, the image forming apparatus can suppress the offset phenomena that come from switching of the transport speed and enjoy the above mentioned advantage without causing the above mentioned disadvantage.

It is to be noted that the single color image means an image realized by a toner having a single color component (e.g. monochrome image), and the multicolor image means an image generated by combination of toners having multiple-color components (e.g. color image that consists of color components: cyan, magenta, yellow, and black).

Further, it is possible to realize a function of the temperature control section with an arrangement such that the above fixing apparatus includes (i) a first heat source device which is a heat source of the external heating member and heats in response to power supply to the first heat source device, (ii) a first temperature sensor which detects a temperature of the external heating member, and (iii) a heat source control device which controls power supply to the first heat source device so that the temperature detected by the first temperature sensor reaches a first setting temperature; and the heat source control device performs the process of selecting a value of the first setting temperature in accordance with a transport speed of the recording material.

The above fixing apparatus may be arranged such that the fixing apparatus includes a second heat source device which is disposed inside the fixing roller and heats in response to power supply to the second heat source device and (b) a second temperature sensor which detects a temperature of the outer surface of the fixing roller, and the heat source control device controls power supply to the first heat source device and the second heat source device so that the temperature detected by the first temperature sensor reaches the first setting temperature and the temperature detected by the second temperature sensor reaches a second setting temperature.

In the above arrangement, the temperature control device may be arranged so as to set the first setting temperature and the second setting temperature to an identical value under standby condition where image forming operation is not performed by the image forming apparatus which includes the fixing apparatus.

This arrangement suppresses local overheating in only a part of the outer surface of the fixing roller in contact with the external heating member, and thus prevents the occurrence of high temperature offset, at a position on the recording material where the recording material comes into contact with the local overheating part of the fixing roller, when the image forming apparatus including the fixing apparatus performs the fixing process by performing image forming operation.

Further it is preferable that if the temperature detected by the first temperature sensor does not reach the first setting temperature under recording material passing condition where the image forming operation is performed by the image forming apparatus, the heat source control device preferentially supplies power to the first heat source device.

According to this arrangement, if a temperature of the external heating device does not reach the first setting temperature under the recording material passing condition, power supply to the first heat source device is preferentially performed. This makes it possible to increase the amount of power that is available for supply to the first heat source device, thus more quickly raising a temperature of the external heating device.

Further, it is preferable that if the temperature detected by the first temperature sensor reaches the first setting temperature under the recording material passing condition, the heat source control device stops supplying power to the first heat source device and supplies power to the second heat source device.

According to this arrangement, if the temperature detected by the first temperature sensor reaches the first setting temperature under the recording material passing condition, heat generation from the first heat source device of the external heating member is stopped so that the second heat source device inside the fixing roller heats. This makes heat on the outer surface of the fixing roller hard to transfer to the inside of the fixing roller, and suppresses a quick cooling of the outer surface of the fixing roller. Thus, the outer surface temperature of the fixing roller can be held at a temperature that is close to the second setting temperature for a longer period of time.

Further, in addition to the above arrangement, the fixing apparatus of the present invention is preferably such that: the endless belt is set over first and second support rollers and rotates opposite in direction to the rotation of the fixing roller, and a nip area is formed between the endless belt and the outer surface of the fixing roller; around the nip area, a first support roller is disposed upstream with respect to a driving direction of the endless belt, and a second support roller is disposed downstream with respect to a driving direction of the endless belt; and the first support roller includes the first heat source device therein, and the second support roller does not include the first heat source device therein.

According to this arrangement, a temperature of the endless belt decreases as the endless belt travels from upstream to downstream of the nip area. Therefore, in the temperature distribution of the entire endless belt, the endless belt does not have the lowest temperature at the position corresponding to the nip area. Thus, it is possible to efficiently heat the outer surface of the fixing roller at the position of the endless belt corresponding to the nip area. On the contrary, in cases where respective first heat source devices are provided in the first support roller and the second support roller, in the temperature distribution of the endless belt, the endless belt has the highest temperature at positions corresponding to the first and second support rollers, and has the lowest temperature at position corresponding to the nip area that locates between the first support roller and the second support roller. Thus, it is impossible to efficiently heat the outer surface of the fixing roller at the position of the endless belt corresponding to the nip area.

Further, in addition to the above arrangement, the fixing apparatus of the present invention may be such that: the endless belt is set over first and second support rollers; each of the first and second support rollers includes the first heat source device therein; and the first and second support rollers are identical in shape, size, their constituent components, and material and size of the constituent components.

With this arrangement, a temperature of a position a where the endless belt is in contact with the first support roller becomes substantially the same as a temperature of a position b where the endless belt is in contact with the second support roller. It is therefore enough to provide the first temperature sensor that detects a temperature of the endless belt as the external heating member, at a position close to either the position a or the position b (i.e. a single temperature sensor is enough.). This makes it possible to reduce constituent temperature sensor counts. However, when the first support roller and the second support roller are not identical in shape, constituent components, material, size, and others in the arrangement where the first support roller and the second support roller each includes the first heat source device, a temperature of the position a where the endless belt is in contact with the first support roller becomes different from a temperature of the position b where the endless belt is in contact with the second support roller. Unless temperature sensors are provided at respective positions close to both the position a and the position b of the endless belt, an appropriate temperature control is impossible.

Further, the present invention may be such that an image forming apparatus includes a fixing roller and a pressure roller, and performs a process in which a recording material is transported between the fixing roller and the pressure roller, so that an unfixed image formed on the recording material is fixed on the recording material under heat of the fixing roller, and the image forming apparatus further includes: an external heating member which heats the outer surface of the fixing roller by external contact with the outer surface of the fixing roller; and a temperature control section which controls a temperature of the external heating member in accordance with a transport speed of the recording material. This arrangement can also bring about an effect that is substantially the same as the above mentioned effect.

Still further, the present invention may be such that a method for controlling a temperature of a fixing apparatus includes: a fixing roller; and a pressure roller; and an external heating member which heats the outer surface of the fixing roller by external contact with the outer surface of the fixing roller, wherein a recording material is transported between the fixing roller and the pressure roller, so that an unfixed image formed on the recording material is fixed on the recording material under heat of the fixing roller, and the method includes the step of: performing control so that a temperature of the external heating member is changed in accordance with a transport speed of the recording material. This arrangement can also bring about an effect that is substantially the same as the above mentioned effect.

Note that the temperature control method may be realized by a computer. In such a case, (i) a temperature control program which causes a computer to execute the above mentioned step and (ii) a computer-readable storage medium storing therein the temperature control program are also included in the scope of the present invention.

The fixing apparatus and the method for controlling a temperature of the fixing apparatus according to the present invention are applicable to an electrophotographic image forming apparatus, such as printer, copier, facsimile, MFP (Multi Function Printer).

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus comprising: a fixing roller; and a pressure roller, wherein a recording material is transported between the fixing roller and the pressure roller, so that an unfixed image formed on the recording material is fixed on the recording material under heat of the fixing roller, the fixing apparatus further comprising:

an external heating member which heats the outer surface of the fixing roller by external contact with the outer surface of the fixing roller; and a temperature control section which controls a temperature of the external heating member in accordance with a transport speed of the recording material, wherein:

the external heating member is an endless belt which is set over a plurality of support rollers, the temperature control section is made up of (i) a first heat source device which is a heat source of the external heating member and heats in response to power supply to the first heat source device, (ii) a first temperature sensor which detects a temperature of the external heating member, and (iii) a heat source control device which controls power supply to the first heat source device so that the temperature detected by the first temperature sensor reaches a first setting temperature, the heat source control device selects a value of the first setting temperature in accordance with a transport speed of the recording material, the fixing apparatus includes (a) a second heat source device which is disposed inside the fixing roller and heats in response to power supply to the second heat source device and (b) a second temperature sensor which detects a temperature of the outer surface of the fixing roller, the heat source control device controls power supply to the first heat source device and the second heat source device so that the temperature detected by the first temperature sensor takes the first setting temperature and the temperature detected by the second temperature sensor takes a second setting temperature, and the temperature control section sets the first setting temperature and the second setting temperature to an identical value under standby conditions where image forming operation is not performed by the image forming apparatus which includes the fixing apparatus.

2. The fixing apparatus according to claim 1, wherein:

the temperature control section carries out the control so that a temperature of the external heating member increases with increase in transport speed of the recording material.

3. The fixing apparatus according to claim 2, wherein:

the transport speed of the recording material in an image forming apparatus that includes the fixing apparatus is higher in a monochrome mode in which a monochrome image is formed on the recording material than in a multicolor mode in which multicolor image is formed on the recording material.

4. The fixing apparatus according to claim 1, wherein:

if the temperature detected by the first temperature sensor does not reach the first setting temperature under recording material passing conditions where image forming operation is performed by the image forming apparatus, the heat source control device preferentially supplies power to the first heat source device.

5. The fixing apparatus according to claim 4, wherein:

if the temperature detected by the first temperature sensor reaches the first setting temperature under the recording material passing conditions, the heat source control device stops supplying power to the first heat source device and supplies power to the second heat source device.

6. The fixing apparatus according to claim 1, wherein:

the endless belt is set over first and second support rollers and rotates opposite in direction to the rotation of the fixing roller, and a nip area is formed between the endless belt and the outer surface of the fixing roller;

the first support roller and the second support roller are disposed so as to face the fixing roller via the endless belt, the first support roller being disposed upstream of the second support roller with respect to a driving direction of the fixing roller; and the first support roller includes the first heat source device therein, and the second support roller does not include the first heat source device therein.

7. The fixing apparatus according to claim 1, wherein:

the endless belt is set over first and second support rollers;

each of the first and second support rollers includes the first heat source device therein; and the first and second support rollers are identical in shape, size, their constituent components, and material and size of the constituent components.

8. An image forming apparatus comprising a fixing roller and a pressure roller, and performing a process in which a recording material is transported between the fixing roller and the pressure roller, so that an unfixed image formed on the recording material is fixed on the recording material under heat of the fixing roller, the image forming apparatus further comprising:

an external heating member which heats the outer surface of the fixing roller by external contact with the outer surface of the fixing roller; and a temperature control section which controls a temperature of the external heating member in accordance with a transport speed of the recording material, wherein:

the external heating member is an endless belt which is set over a plurality of support rollers, the temperature control section is made up of (i) a first heat source device which is a heat source of the external heating member and heats in response to power supply to the first heat source device, (ii) a first temperature sensor which detects a temperature of the external heating member, and (iii) a heat source control device which controls power supply to the first heat source device so that the temperature detected by the first temperature sensor reaches a first setting temperature, the heat source control device selects a value of the first setting temperature in accordance with a transport speed of the recording material, the image forming apparatus includes (a) a second heat source device which is disposed inside the fixing roller and heats in response to power supply to the second heat source device and (b) a second temperature sensor which detects a temperature of the outer surface of the fixing roller, the heat source control device controls power supply to the first heat source device and the second heat source device so that the temperature detected by the first temperature sensor takes the first setting temperature and the temperature detected by the second temperature sensor takes a second setting temperature, and the temperature control section sets the first setting temperature and the second setting temperature to an identical value under standby conditions where image forming operation is not performed by the image forming apparatus.

9. A method for controlling a temperature of a fixing apparatus including: a fixing roller; and a pressure roller; and an external heating member which heats the outer surface of the fixing roller by external contact with the outer surface of the fixing roller, wherein a recording material is transported between the fixing roller and the pressure roller, so that an unfixed image formed on the recording material is fixed on the recording material under heat of the fixing roller, the method comprising the step of:

performing control so that a temperature of the external heating member is changed in accordance with a transport speed of the recording material, wherein:

the external heating member is an endless belt which is set over a plurality of support rollers, the fixing apparatus includes a temperature control section made up of (i) a first heat source device which is a heat source of the external heating member and heats in response to power supply to the first heat source device, (ii) a first temperature sensor which detects a temperature of the external heating member, (iii) a second heat source device which is disposed inside the fixing roller and heats in response to power supply to the second heat source device and (iv) a second temperature sensor which detects a temperature of the outer surface of the fixing roller, the step of performing control comprising:

controlling power supply to the first heat source device so that the temperature detected by the first temperature sensor reaches a first setting temperature, selecting a value of the first setting temperature in accordance with a transport speed of the recording material, controlling power supply to the first heat source device and the second heat source device so that the temperature detected by the first temperature sensor takes the first setting temperature and the temperature detected by the second temperature sensor takes a second setting temperature, and setting the first setting temperature and the second setting temperature to an identical value under standby conditions where image forming operation is not performed by the image forming apparatus which includes the fixing apparatus.

10. A non-transitory computer-readable storage medium storing therein a temperature control program for realizing in a computer a method for controlling a temperature of a fixing apparatus including: a fixing roller; and a pressure roller; and an external heating member which heats the outer surface of the fixing roller by external contact with the outer surface of the fixing roller, wherein a recording material is transported between the fixing roller and the pressure roller, so that an unfixed image formed on the recording material is fixed on the recording material under heat of the fixing roller, the method comprising a temperature controlling step of performing control so that a temperature of the external heating member is changed in accordance with a transport speed of the recording material, wherein the temperature controlling step is executed by the computer, wherein:

the external heating member is an endless belt which is set over a plurality of support rollers, the fixing apparatus includes a temperature control section made up of (i) a first heat source device which is a heat source of the external heating member and heats in response to power supply to the first heat source device, (ii) a first temperature sensor which detects a temperature of the external heating member, (iii) a second heat source device which is disposed inside the fixing roller and heats in response to power supply to the second heat source device and (iv) a second temperature sensor which detects a temperature of the outer surface of the fixing roller, the temperature controlling step of performing control comprising:

controlling power supply to the first heat source device so that the temperature detected by the first temperature sensor reaches a first setting temperature, selecting a value of the first setting temperature in accordance with a transport speed of the recording material, controlling power supply to the first heat source device and the second heat source device so that the temperature detected by the first temperature sensor takes the first setting temperature and the temperature detected by the second temperature sensor takes a second setting temperature, and setting the first setting temperature and the second setting temperature to an identical value under standby conditions where image forming operation is not performed by the image forming apparatus which includes the fixing apparatus.

* * * * *